US005965332A

United States Patent [19]

Kikuchi

[11] Patent Number: 5,965,332

[45] Date of Patent: Oct. 12, 1999

[54] SILVER HALIDE COLOR PHOTOSENSITIVE MATERIAL AND METHOD FOR FORMING COLOR IMAGES

[75] Inventor: Makoto Kikuchi, Kanagawa, Japan

[73] Assignee: Fuji Photo Film Co., Ltd., Kanagawa, Japan

[ * ] Notice: This patent is subject to a terminal disclaimer.

[21] Appl. No.: 08/912,846

[22] Filed: Aug. 19, 1997

[30] Foreign Application Priority Data

Aug. 19, 1996 [JP] Japan ..... 8-217414

[51] Int. Cl.[6] ..... G03C 5/00; G03C 1/42

[52] U.S. Cl. ..... 430/351; 430/203; 430/374; 430/405; 430/415; 430/440; 430/567

[58] Field of Search ..... 430/351, 405, 430/380, 415, 203, 617, 440, 619, 234, 567, 354, 374

[56] References Cited

U.S. PATENT DOCUMENTS 4,435,499 3/1984 Reeves ..... 430/350
5,268,262 12/1993 Shibahara et al. ..... 430/506
5,578,435 11/1996 Ihama ..... 430/501
5,667,945 9/1997 Takeuchi et al. ..... 430/380
5,677,104 10/1997 Hirai et al. ..... 430/203

*Primary Examiner*—Thorl Chea
*Attorney, Agent, or Firm*—Sughrue, Mion, Zinn, Macpeak & Seas, PLLC

[57] ABSTRACT

A silver halide color photosensitive material comprises a support provided thereon with a photosensitive silver halide, a developing agent, a coupler, and a binder. After exposure, the photosensitive material is placed, onto a processing material comprising a support provided with a processing layer thereon which contains a base and/or a precursor of a base, with water being present between the photosensitive material and the processing material in an amount of 1/10through 1 times that required to maximally swell the layers of the materials. The resultant assembly is heated to form an image on the photosensitive material. The photosensitive material includes an emulsion in which tabular silver halide grains having an aspect ratio of 2 to 30 account for 50% to 100% of the total projected area of all silver halide grains and in which 50% to 100% of all silver halide grains in number include 10 or more dislocation lines per grain. A method of forming images using this photosensitive material is also disclosed.

21 Claims, No Drawings

SILVER HALIDE COLOR PHOTOSENSITIVE MATERIAL AND METHOD FOR FORMING COLOR IMAGES

BACKGROUND OF THE INVENTION

1. Field of the Invention

The present invention relates to a novel silver halide color photosensitive material and a method for forming color images through use of the same.

2. Description of the Related Art

Recently, the development of photosensitive materials using silver halide has markedly advanced, high-quality color images are now obtained easily. In ordinary color photography, photography is done using a color negative, and image information recorded on a color negative which has undergone development is printed optically onto photographic color printing paper to obtain color prints. This process has become highly developed in recent years, resulting in the popularization of color laboratories, or large-scale facilities for producing large numbers of color prints highly efficiently, and so-called minilaboratories, or simple, compact printer-processors installed in shops, thus making it possible for anyone to readily enjoy color photography.

The principle of currently popular color photography employs the subtractive color process for reproducing colors. An ordinary color negative comprises a transparent support provided with light-sensitive layers thereon, each of which comprises a silver halide emulsion and a so-called color coupler, the silver halide emulsions being light-sensitive elements which have individual sensitivity in blue, green, and red regions, and the color couplers functioning to form dyes of yellow, magenta, and cyan, each having the relationship of a complementary color for respective light-sensitivities. A color negative is exposed imagewise in photography and is then developed in a color developer, which comprises aromatic primary amine serving as a developing agent. In this step, exposed silver halide grains are developed or reduced with the developing agent, and the oxidized product of the developing agent (the oxidized product is formed concurrently with reduction) and the above-described color coupler undergo a coupling reaction to form dyes of individual colors. Metallic silver (developed silver) formed through development and unreacted silver halide are removed by bleach-fixing, thereby to obtain dyeimages. Color-photographic printing paper, i.e., a color photosensitive material comprising a reflective support provided with light-sensitive layers thereon, each of which has a combination of a photosensitive wavelength region and a color to be developed as does a color negative, is exposed to light which has passed through a developed color negative, followed by color development and bleach-fixing similar to those employed for a color negative. Thus, color prints are obtained, each of which comprises a dye image which reproduces an original scene.

Requests are growing for the simplification of these currently popular color image formation systems. First of all, in conducting the above-described color development and bleach-fixing, the compositions and temperature of relevant baths must be accurately controlled, requiring special knowledge and skills in operation. Second, these processing solutions contain environmentally regulated substances, such as color developing agents and the iron chelate compound serving as a bleaching agent, and thus developing equipment must be designed to regulate these waste substances. Third, the time required for development processing has been shortened through recent technological advances, but still is not short enough to meet requests for the rapid reproduction of recorded images.

Under the circumstances, to lighten the environmental load and to simplify the color image formation process, requests are increasing for a color image formation system which does not use currently used color developing and bleaching agents.

In light of the aforementioned problems, various improved techniques have been proposed. Page 180 of the IS & T 48th Annual Conference Proceedings, for example, discloses a system in which dyes generated through a development reaction are transferred to a mordant layer, and the mordant layer is then separated, thereby removing developed silver and unreacted silver halide, making the bleach-fix bathing conventionally required for photographic processing unnecessary. The proposed technique still requires development processing in a processing bath which contains a color developing agent, however. Thus, the above-mentioned environmental problems, cannot be said to have been solved yet.

As a system that does not require a processing solution that includes a color developing agent, Fuji Photo Film Co., Ltd., provides the Pictography system. In this system, a small amount of water is supplied to a light-sensitive member which contains a small amount of base precursors. The light-sensitive member is placed onto an image-receiving member, and the resulting assembly is heated to initiate a development reaction. This system is environmentally advantageous because it does not use the aforementioned processing bath. In this system, however, the thus-formed dyes are fixed in a dye-fixing layer to form dye images to be viewed. Therefore, it is desired to develop a system capable of applying this technique to recording materials for photograph-taking use. To be used as the material for photograph-taking-use, the silver halide emulsion used must have high sensitivity, excellent granularity, and excellent pressure resistance.

A technique for improving the sensitivity and granularity of the silver halide emulsion uses tabular grains. Techniques for using tabular grains in heat development system are disclosed in U.S. Pat. No. 4,435,499, Japanese Patent Application Publication (JP-B) No. 2-48101, Japanese Patent Application Laid-Open (JP-A) Nos. 61-77048, 62-78555, and 62-79447.

Studies conducted by the present inventors, however, have revealed that, compared to the case with liquid development, pressure fogging is a far worse problem in heat development which uses a silver halide emulsion comprising tabular silver halide grains in accordance with the above-mentioned technique.

Pressure fogging is caused, for example, by a grain of sand getting into a camera and coming in contact with the emulsion side of film. When pressure is applied to the portion of contact during film travel, the portion of the film to which pressure is applied becomes fogged. This fogging appears as a problem in the form of a scratch in an image area, making the reduction of pressure fogging highly desirable.

SUMMARY OF THE INVENTION

A primary object of the present invention is to provide a silver halide color photosensitive material capable of forming images simply and rapidly with less burden on the environment and, further, to provide a silver halide color photosensitive material for photograph-taking use capable of providing high sensitivity and good granularity even in simple, fast processing, and particularly capable of exhibiting excellent pressure resistance.

The above object is effectively achieved by the present invention described below.

(1) The present invention provides a silver halide color photosensitive material comprising a support provided with at least one photosensitive layer thereon, which comprises light-sensitive silver halide, a developing agent, a compound to form a dye through a coupling reaction with an oxidized product of the developing agent, and a binder, the photosensitive material being placed, after exposure, onto a processing material comprising a support having a processing layer on which contains a base and/or a base precursor, with water present between the photosensitive material and the processing material in an amount of 1/10 through 1 times that required to maximally swell the layers of materials, the resultant assembly being heated to form an image on the photosensitive material, wherein the photosensitive material includes an emulsion in which tabular silver halide grains of an aspect ratio of 2 to 30 account for 50% to 100% of the total projected area of all silver halide grains and in which 50% to 100% of all silver halide grains in number include 10 or more dislocation lines per grain.

(2) Preferably, 80% to 100% of silver halide grains in number include 10 or more dislocation lines per grain.

(3) Preferably, the developing agent is a compound represented by one of following formulae I, II, III, and IV:

Formula I

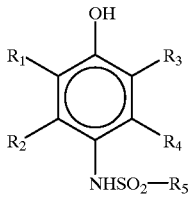

Formula II

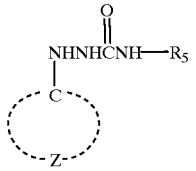

Formula III

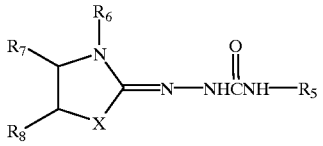

Formula IV

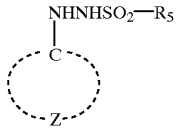

In the above formulae, each of $R_1$, to $R_4$ represents a hydrogen atom, a halogen atom, an alkyl group, an aryl group, an alkylcarbonamide group, an arylcarbonamide group, an alkylsulfonamide group, arylsulfonamide group, an alkoxy group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group, or an acyloxy group; $R_5$ represents an alkyl group, aryl group, or a heterocyclic group; Z represents a group of atoms that forms a (hetero) aromatic ring, wherein provided that Z is a benzene ring, a total of its Hammett's substituent constants ($\sigma$) is 1 or more; $R_6$ represents an alkyl group; X represents an oxygen atom, a sulfur atom, a selenium atom, or an alkyl-substituted or aryl-substituted tertiary nitrogen atom; and each of $R_7$ and $R_8$ represents a hydrogen atom or a substituent, and $R_7$ and $R_8$ may be linked to each other so as to form a double bond or a ring. Each of formulae I, II, III, and IV includes at least one ballast group of 8 or more carbons in order to impart oil solubility to molecules.

(4) The present invention provides a method of forming color photosensitive material imagewisely, supplying water to the photosensitive material or a processing material in a amount of 1/10 through 1 times that required to maximally swell the photosensitive material and the processing material, placing the photosensitive material onto the processing material, and heating the resultant assembly to a temperature of 60° C. to 100° C. and maintaining the temperature for 5 to 60 seconds to form color images.

As mentioned previously, a technique for using tabular grains in heat development is disclosed, e.g., in U.S. Pat. No. 4,435,499.

However, in contrast to the present invention, these patents, which disclose techniques for using tabular grains in heat development, do not mention the preferred embodiment of the present invention; i.e., the use of an emulsion in which tabular silver halide grains of an aspect ratio of 2 to 30 account for 50% to 100% of the total projected area of all silver halide grains and in which 50% to 100% of all silver halide grains in number include 10 or more dislocation lines per grain. In particular, these patents do not refer to a technique for introducing dislocation lines into tabular grains. Further, these patents do not imply an attempt to improve pressure resistance associated with an attempt to improve sensitivity and granularity in heat development.

The inventors of the present invention conducted extensive studies and found that by applying an emulsion comprising tabular sliver halide grains which include 10 or more dislocation lines per grain to the heat-development type photosensitive material of the present invention, sensitivity and granularity are improved and pressure fogging is effectively reduced, and further found, against conventional knowledge on liquid development, the unanticipate effect that pressure fogging can be reduced without impairing pressure desensitization.

As disclosed in Japanese Patent Application Laid-Open (JP-A) No. 1-329231, even in a commonly employed liquid-development-type photographic system, an emulsion comprising tabular grains which include dislocation lines exhibits excellent photographic properties such as sensitivity and gradation.

It is commonly known, however, that when highly-dense dislocation lines are introduced into grains in order to attain high sensitivity, these dislocation lines function as electron traps in the inside of the grains, and thus internal sensitivity tends to increase compared with surface sensitivity. Further, grains including dislocation lines are likely to be desensitized when pressure is applied. That is, improving the resistance to both pressure fogging and pressure desensitization was difficult.

The present invention is the first to provide a heat-development-type photosensitive material having high sensitivity, excellent granularity, and improved resistance to both pressure fogging and pressure desensitization.

DESCRIPTION OF THE PREFERRED EMBODIMENTS

The present invention can basically employ color reproduction through a subtractive color process in the construction of a photosensitive material used for recording original scenes and reproducing recorded scenes in the form of color images. That is, at least three light-sensitive layers are provided which have individual sensitivities in blue, green, and red regions, each layer of which contains a color coupler capable of forming dyes of yellow, magenta, or cyan having the relationship of a complementary color to its own wavelength region of sensitivity, thereby recording color information about original scenes. Color photographic printing paper having a relation between wavelengths of sensitivity and hues to be developed similar to that of the photosensitive material is exposed to light which has passed through the thus-obtained dye images, to thereby reproduce original scenes. Alternatively, information about dye images obtained through the photographing of original scenes may be read by a scanner or the like and, based on thus-read information, images may be reproduced for viewing.

A photosensitive material of the present invention may comprise a light-sensitive layer having sensitivity in three or more wavelength regions.

Wavelength regions of sensitivity and hues to be developed may also have other than the above-mentioned relationship of a complementary color to light sensitivity. In such a case, read image information which is read may undergo image processing such as hue conversion to reproduce original color information.

Conventionally, in order to attain a desired granularity value of a color negative for photograph-taking use, the silver halide emulsion has been improved, and a so-called DIR coupler has been used which releases a development-inhibiting compound upon the coupling reaction with an oxidized product of a developing agent. The photosensitive material of the present invention provides an excellent degree of granularity value even when no DIR coupler is used. This degree of granularity will be made even better in combination with the DIR compound .

Emulsions used in the present invention are explained below.

In the present invention, a tabular grain means a silver halide grain having two main opposed parallel planes.

The tabular grain of the present invention has one twin crystal plane or two or more sets of parallel twin crystal planes.

By twin crystal planes is meant that are ions at all lattice points have a mirror image relationship at the both sides of a (111) plane.

A tabular grain has outer surfaces arranged parallel to other and which, when viewed from above, are triangularly shaped, or hexagonally shaped, or are of a rounded form of these shapes.

Aspect ratio means the thickness-to-diameter ratio of a silver halide grain. That is, the aspect ratio of a silver halide grain is the value obtained by dividing the diameter of a circular area equivalent to a projected area (hereinafter referred to as the "circle-equivalent diameter") of the silver halide grain by the grain thickness. The aspect ratio is obtained, for example, from a transmission electron micrograph of grains through calculation based on the circle-equivalent diameter and the thickness of each grain. In this case, the thickness of a grain is calculated from the length of the shadow of a replica of the grain (the replica).

Emulsions used in the present invention are such that tabular silver halide grains having an aspect ratio of 2 to 30, preferably 3 to 30, and 4 to 30 is particularly preferable, account for 50% to 100% of the total projected area of all silver halide grains.

An aspect ratio of less than 2 fails to make the most of the advantages of the tabular grain (high sensitivity and improved lower-layer sharpness). An aspect ratio exceeding 30 make resistance to damage by pressure (hereinafter referred to as pressure resistance) poor.

For tabular grains used in the present invention, a value obtained by dividing the average circle-equivalent diameter by the square of the average thickness (a value defined as ECD/t2 in Japanese Patent Application Laid-Open (JP-A) No. 3-135335) is not less than 5 or more, preferably 10 or more, and more preferably 15 or more.

The circle-equivalent diameter of the tabular grains used in the present invention is preferably 0.3 to 3 $\mu$m, more preferably 0.4 to 2.5 $\mu$m, and more preferably 0.5 to 2 $\mu$m. A circle-equivalent diameter of less than 0.3 $\mu$m fails to make the most of the advantages of the tabular grain. A circle-equivalent diameter exceeding 3 $\mu$m worsens pressure resistance.

The thickness of tabular grains used in the present invention is preferably 0.05 to 1.0 $\mu$m, more preferably 0.08 to 0.5 $\mu$m, and 0.08 to 0.3 $\mu$m is particularly preferable. A thickness of less than 0.05 $\mu$m worsens pressure resistance. A thickness exceeding 1.0 $\mu$m fails to make the most of the advantage of the tabular grain.

Emulsions used in the present invention contain hexagonal tabular grains whose ratio of the length of the longest side to that of the shortest side is 2:1 and whose tabular grains account for preferably 50% to 100%, more preferably 70% to 100%, and 90% to 100% is particularly preferable, of the total projected area of all grains contained in the emulsion. The coexistence of tabular grains of other than the above-described hexagonal shape is not preferable in view of grain homogeneity.

Emulsions used in the present invention are preferably a monodispersion.

The coefficient of variation in the circle-equivalent diameter of the silver halide grains used in the present invention is preferably 20% to 3%, more preferably 15% to 3%, particularly preferably 10% to 3%. A coefficient exceeding 20% is not preferable in view of grain homogeneity.

The coefficient of variation in the circle-equivalent diameter is a value obtained by dividing the standard deviation of circle-equivalent diameters of silver halide grains by the average circle-equivalent diameter.

Emulsion grains used in the present invention are silver halides which contain silver iodide, and contain at least one of a silver iodide phase, a silver iodobromide phase, a silver chloroiodobromide phase, and a silver chloroiodide phase.

Other silver salts, for example, silver rhodanide, silver sulfide, silver selenide, silver carbonate, silver phosphate, and silver salt of organic acids may be contained as separate grains or a part of silver halide grains.

Tabular grains used in the present invention preferably comprise silver iodobromide or silver chloroiodobromide.

The silver iodide content of emulsion grains used in the present invention ranges preferably from 0.1 mol % to 20 mol %, more preferably from 0.3 mol % to 15 mol %, and particularly preferably from 1 mol % to 10 mol %, but may be selected from these ranges depending on the intended purpose. A silver iodide content exceeding of 20 mol % is not preferable because it usually decreases development speed.

Tabular grains used in the present invention have dislocation lines. A dislocation line is a linear lattice defect occurring along the boundary between the region of a slipped crystal face and the region of a nonslipped crystal face.

References on dislocation lines of a silver halide crystal include 1) C. R. Berry, J. Appl. Phys., 27, 636 (1956); 2) C. R. Berry, D. C. Skilman, J. Appl. Phys., 35, 2165 (1964); 3) J. F. Hamilton, Phot. Sci. Eng., 11, 57 (1967); 4) T. Shiozawa, J. Soc. Phot. Sci. Jap., 34, 16 (1971); 5) T. Shiozawa, J. Soc. Phot. Sci. Jap., 35, 213 (1972). Dislocation lines can be analyzed by the X-ray diffraction method or the direct observation method through the use of a low-temperature transmission electron microscope.

When dislocation lines are to be directly observed through a transmission electron microscope, care must be taken not to apply so much pressure to silver halide grains removed from an emulsion that an addition dislocation line is generated in grains, and removed grains are placed on a mesh for observation through an electron microscope and are then observed by the electron transmission method during cooling to prevent electron-beam-induced damage (such as printout).

In this case, since thicker grains are less likely to transmit electron beams, it is desirable to use a high-voltage (200 kV or higher for a 0.25 $\mu$m thickness) electron microscope in order to obtain a clear view.

In the meantime, the effect of dislocation lines on photographic performance is discussed in G. C. Farnell, R. B. Flint, J. B. Chanter, J. Phot. Sci., 13, 25 (1965). According to this reference, for tabular silver halide grains having a large size and a high aspect ratio, the place where a latent image nucleus is formed is closely related to a defect within a grain.

Japanese Patent Application Laid-Open (JP-A) Nos. 63-220238 and 1-201649 disclose tabular grains into which dislocation lines are intentionally introduced.

According to these patent applications, tabular grains in which dislocation lines are introduced have been shown to have superior photographic characteristics such as sensitivity and reciprocity law characteristic, as compared with tabular grains having no dislocation lines.

In the present invention, dislocation lines are introduced into tabular grains preferably in the following manner:

Dislocation lines are introduced into a tabular grain that serves as a base (also called a "host grain") through epitaxial growth of the silver halide phase including silver iodide and subsequent formation of a silver halide shell.

The silver iodide content of a host grain is preferably 0 to 15 mol %, more preferably 0 to 12 mol %, and particularly preferably 0 mol % to 10 mol %, but may be selected from these ranges depending on the intended purpose. A silver iodide content exceeding of 15 mol % usually decreases development speed. The silver iodide content of the silver halide phase to be formed on a host grain through epitaxial growth is preferably higher.

The silver halide phase to be formed through epitaxial growth may comprise any of silver iodide, silver iodobromide, silver chloroiodobromide, and silver chloroiodide but preferably comprises silver iodide or silver iodobromide, and more preferably silver iodide.

When the silver halide phase comprises silver iodobromide, its silver iodide (iodide ion) content is preferably 1 to 45 mol %, more preferably 5 to 45 mol %, and particularly preferably 10 to 45 mol %. In view of the formation of the misfit required for dislocation line introduction, a higher silver iodide content is preferable, but the solid solution limit of silver iodobromide is 45 mol %.

In order to form this phase of a high silver iodide content on host grains through epitaxial growth, halides are added preferably 2 to 15 mol % of the amount of silver of host grains, more preferably 2 to 10 mol %, and particularly preferably 2 to 5 mol %. When halogens are added less than 2 mol %, dislocation lines become more difficult to introduce. When halides are added exceeding 15 mol %, development speed decreases.

At this time, this high silver iodide content phase is preferably 5 to 80 mol % of the amount of silver of all grains, more preferably 10 to 70 mol %, and particularly preferably 20 to 60 mol %. When this phase is present at either less than 5 mol % or exceeding 80 mol %, dislocation lines becomes more difficult to introduce.

Further this high silver iodide content phase may be formed on a host grain at any location or may be formed on a host grain to cover the host grain or at a certain portion thereof but is preferably formed through epitaxial growth at a selected portion to thereby control the location of a dislocation line in a host grain.

In the present invention, particularly preferably, the high silver iodide content phase is formed at an edge on a tabular host grain. In this case, the composition of halides to be added, the method of adding, and the conditions of a reaction solution, such as temperature, pAg, solvent concentration, gelatin concentration, and ionic strength, may be selected freely.

After epitaxial growth, a silver halide shell is formed on the exterior of a tabular host grain and introduces dislocation lines into the host grain.

The silver halide shell may comprise any of silver bromide, silver iodobromide, and silver chloroiodobromide but preferably comprises silver bromide or silver iodobromide.

When the silver halide shell comprises silver iodobromide, its silver iodide content is preferably 0.1 to 12 mol %, more preferably 0.1 to 10 mol %, most preferably 0.1 to 3 mol %. When the silver iodide content is less than 0.1 mol %, effects such as strengthened sensitizing dye adsorption and enhanced development are difficult to attain. When the silver iodide content exceeds 12 mol %, the development speed decreases.

In order to grow silver halide shells, silver may be used in any amount 5 mol % or more of host grains.

In the above-described dislocation line introduction process, the processing temperature is preferably 30° C. to 80° C., more preferably 35° C. to 70° C., and particularly preferably 35° C. to 60° C. Temperature control lower than 30° C. or exceeding 80° C. requires high-performance manufacturing equipment, which is disadvantageous to manufacture.

The pAg ranges preferably from 6.4 to 10.5.

In the case of tabular grains, the location and number of dislocation lines as viewed in a direction perpendicular to the main plane can be obtained for each grain from the photograph of grains taken through an electron microscope, as described previously.

Since the incline of a specimen relative to the electron beam determines whether dislocation lines will be seen or not, the dislocation lines of a certain grain must be obtained through observation of photographs of the same grain taken at as many inclines of a specimen as possible in order to observe all dislocation lines.

In the present invention, preferably, the incline of a specimen is changed at 5-degree steps to take five photographs of the same grain through a high voltage electron microscope, and then the location and number of dislocation lines of the grain are obtained from the five photographs.

In the present invention, dislocation lines may be introduced into a tabular grain so as to be localized to only vertex or fringe portions or may be introduced over the entire main plane but are preferably localized to only fringe portions.

In the present invention, the fringe portion means the peripheral portion of a tabular grain, specifically the portion of a tabular grain located outside a point at which a silver iodide content first exceeds or falls below the average silver iodide content of the entire tabular grain as a silver iodide distribution is traced from a side of the tabular grain toward the grain center.

In the present invention, dislocation lines preferably are densely introduced into silver halide grains.

Tabular grains used in the present invention preferably have 10 or more dislocation lines per grain at the fringe portion of a grain as counted through an electron microscope as described above, more preferably 30 or more, and particularly preferably 50 or more.

Tabular grains having fewer than 10 dislocation lines per grain make it difficult to ensure the effect of improved sensitivity.

When dislocation lines exist densely or intersecting, it may be difficult to precisely count the number of dislocation lines per grain. Even in such a case, dislocation lines may be roughly counted as 10, 20, 30, or the like.

In the present invention, the distribution of dislocation lines in number is preferably uniform among silver halide grains.

In emulsions used in the present invention, silver halide grains which include 10 or more dislocation lines per grain preferably account for 50% to 100% of all grains in number, more preferably 70% to 100%, and particularly preferably 80% to 100%. When the number of silver halide grains which include 10 or more dislocation lines per grain is 50% or less of all grains, homogeneity among grains deteriorates to an undesirable level.

In the present invention, the ratio of grains including dislocation lines to all grains and the number of dislocation lines are preferably obtained through direct observation of dislocation lines for at 100 or more grains, more preferably for 200 or more grains, and particularly preferably for 300 or more grains.

In the present invention, during epitaxial growth in the aforementioned process of introducing dislocation lines into tabular grains, the silver halide phase including silver iodide is preferably formed while iodide ions are being rapidly generated through the use of an iodide-ion-releasing agent described in, e.g., U.S. Pat. No. 5,498,516, instead of use of the conventional iodide ion supply method (a method of adding free iodide ions).

Emulsions used in the present invention and other photographic emulsions to be used therewith are explained below.

Specifically, the present invention can use any of silver halide emulsions prepared using various methods as described, for example, in U.S. Pat. No. 4,500,626 (column 50); U.S. Pat. No. 4,628,021, Research Disclosure (hereinafter abbreviated RD,) No.17029 (1978); RD No. 17643, pp.22-23 (Dec. 1978); RD No. 18716, p. 648 (Nov. 1979); RD No. 307105, pp. 863–865 (Nov. 1989); Japanese Patent Application Laid-Open (JP-A) Nos. 62-253159, 64-13546, 2-236546, and 3-110555; and, further, P. Grafkides, Chemie et Phisque_Photographique, Paul Montel, Paris (1967); G. F. Duffin, Photographic Emulsion Chemistry, Focal Press, London (1966); V. L. Zelikman et al., Making and Coating Photographic Emulsion, Focal Press, London (1964); and so on.

In a process of preparing the present light-sensitive silver halide emulsion, it is preferable to conduct a so-called desalting method, that is, removal of excess salts from the silver halide emulsion. Removal can be effected using the noodle washing method which comprises gelling the gelatin, or using a flocculation method which make the most of a polyvalent anion-containing inorganic salt (such as sodium sulfate), an anionic surfactant, an anionic polymer (such as sodium polystyrenesulfonate), or a gelatin derivative (such as an aliphatic acylated gelatin, an aromatic acylated gelatin or an aromatic carbamoylated gelatin). Such a flocculation method is employed preferably in the present invention.

To the light-sensitive silver halide emulsions used in the present invention, heavy metal ions such as iridium, rhodium, platinum, cadmium, zinc, thallium, lead, iron and osmium ions can be added for various purposes. Such metal ions may be used alone, or in combinations of two or more. The amount of heavy metal ions added, through it is generally $10^{-9}$ to $10^{-3}$ mol per mol of silver halide, depending on the intended purpose. These metal ions may be introduced into emulsion grains so that the distribution of the metal ions is uniform throughout the grains or localized in the inner or surface part of grains. Specifically, the emulsions described, e.g., in Japanese Patent Application Laid-Open (JP-A) Nos. 2-236542, 1-116637, and 5-181246 are preferably used.

In the step for the formation of silver halide grains for the present light-sensitive silver halide emulsions, a rhodanate, ammonia, a tetra-substituted thiourea compound, an organic thioether compound as described in Japanese Patent Application Publication (JP-B) No. 47-11386, a sulfur containing compound as described in Japanese Patent Application Laid-Open (JP-A) No. 53-144319, or so on can be used as a silver halide solvent.

For details about other conditions under which silver halide emulsions used in the present invention can be prepared, descriptions in the above-cited books, namely P. Grafkides, Chemie et Phisque Photographique, Paul Montel, Paris (1967); G. F. Duffin, Photographic Emulsion Chemistry, Focal Press, London (1966); and V. L. Zelikman et al., Making and Coating Photographic Emulsion, Focal Press, London (1964); can be referenced. Specifically, the present silver halide emulsions can be prepared by any of an acid process, a neutral process, and an ammonia process. Further, a method suitable for allowing to react a water-soluble silver salt with a water-soluble halide can be any of a single-jet method, a double jet method, and a combination thereof. In order to obtain a monodisperse emulsion, a double jet method is preferably adopted.

Also, a reverse mixing method in which silver halide grains are produced in the presence of excess silver ions can be employed. In addition, the so-called controlled double jet method as a method of double jet mehods, in which the pAg of the liquid phase in which silver halide grains are to be precipitated is maintained constant, can be used.

To increase the speed of grain growth, concentrations, amounts, the speeds in adding a silver salt and a halide salt respectively can be increased (as described in Japanese Patent Application Laid-Open (JP-A) Nos. 55-142329 and 55-158124 and U.S. Pat. No. 3,650,757).

Further, the agitation of a reaction solution may be carried out by any of known methods. On the other hand, the temperature and the pH of a reaction solution during the formation of silver halide grains can be chosen depending on the intended purpose. An appropriate pH range is preferably from 2.2 to 7.0, and even more preferably from 2.5 to 6.0.

Light-sensitive silver halide emulsions are, in general, chemically-sensitized silver halide emulsions. In chemically-sensitizing silver halide emulsions used in the present invention, known chemical sensitization processes for emulsions of general photosensitive materials, such as a chalcogen sensitization process, including a sulfur sensitization process, a selenium sensitization process, and a tellurium sensitization process; a noble metal sensitization process using gold, platinum, palladium, or the like; and a reduction sensitization process, can also be employed alone or in combinations of two or more thereof (as described, e.g. in Japanese Patent Application Laid-Open (JP-A) Nos. 3-110555 and 5-241267). Such chemical sensitization can also be also carried out in the presence of a nitrogen-containing heterocyclic compound (as described in Japanese Patent Application Laid-Open (JP-A) No. 62-253159). Further, an antifoggant recited hereinafter can also be added after the conclusion of chemical sensitization. The addition of an antifoggant can be performed as described in Japanese Patent Application Laid-Open (JP-A) Nos. 5-45833 and 62-40446.

During chemical sensitization, the pH is preferably from 5.3 to 10.5, and more preferably from 5.5 to 8.5; the pAg is preferably from 6.0 to 10.5, and more preferably from 6.8 to 9.0.

The coating amount of light-sensitive silver halide used in the present invention ranges from 1 mg to 10 g on a silver basis per square meter of a photosensitive material.

In order to impart color sensitivity, such as green sensitivity and red sensitivity, to light-sensitive silver halide used in the present invention, light-sensitive silver halide emulsions are spectrally sensitized with methine dyes or other dyes. Further, a blue-sensitive silver halide emulsion may be spectrally sensitized in a blue region if needed.

Suitable dyes which can be used for color sensitization include cyanine dyes, merocyanine dyes, complex cyanine dyes, complex merocyanine dyes, holopolar cyanine dyes, hemicyanine dyes, styryl dyes, and hemioxonol dyes.

Specific examples of such sensitizing dyes are recited in U.S. Pat. No. 4,617,257, and Japanese Patent Application Laid-Open (JP-A) Nos. 59-180550, 64-13546, 5-45828, 5-45834, and others.

These sensitizing dyes may be employed individually or in combination. In particular, combinations of sensitizing dyes are often used to supersensitize and adjust the intended spectral sensitization wavelengths.

Dyes which themselves do not spectrally sensitize silver halide emulsions, or compounds which do not substantially absorb light in the visible region, but each of which can exhibit a supersensitizing effect in combination with a certain sensitizing dye, may be incorporated into silver halide emulsions (as described, e.g., in U.S. Pat. No. 3,615,641 and Japanese Patent Application Laid-Open (JP-A) No. 63-23145).

These sensitizing dyes may be added to silver halide emulsions during, before, or after chemical ripening, or before or after the nucleation of silver halide grains according to the embodiments of U.S. Pat. Nos. 4,183,756 and 4,225,666. These sensitizing dyes and supersensitizing materials can also be added as a solution dissolved in an organic solvent, such as methanol, or as dispersion in gelatin, or as a solution comprising a surfactant. A suitable amount of each of such ingredients added is generally from $10^{-8}$ to $10^{-2}$ mole per mole of silver halide.

Additives used in the aforementioned steps and known photographic additives which can be used in the present invention are described in the above-cited RD No. 17643, RD No. 18716, and RD No. 307105. The following is a list of those additives and the locations of their descriptions in the above-cited references:

| Additive | RD 17643 | RD 18716 | RD 307105 |
|---|---|---|---|
| 1. Chemical sensitizer | p. 23 | p. 648, right column | p. 866 |
| 2. Sensitivity-raising agent | | p. 648, right column | |
| 3. Spectral sensitizer and supersensitizing agent | pp. 23–24 | p. 648, right column to p. 649 right column | pp. 866–868 |
| 4. Brightening agent | p. 24 | p. 648, right column | p. 868 |
| 5. Antifoggant and stabilizer | pp. 24–26 | p. 649, right column | pp. 868–870 |
| 6. Light-absorbent, filter dye, and UV absorbent | pp. 25–26 | p. 649, right column to p. 650 left column | p. 873 |
| 7. Dye-image stabilizer | p. 25 | p. 650, left column | p. 872 |
| 8. Hardener | p. 26 | p. 651, left column | pp. 874–875 |
| 9. Binder | p. 26 | p. 651, left column | pp. 873–874 |
| 10. Plasticizer and lubricant | p. 27 | p. 650, right column | p. 876 |
| 11. Coating aid and surfactant | pp. 26–27 | p. 650, right column | pp. 875–876 |
| 12. Antistatic agent | p. 27 | p. 650, right column | pp. 876–877 |
| 13. Matting agent | | | pp. 878–879 |

In the present invention, organometal salts can be used as oxidizing agent together with light-sensitive silver halide. Of organometal salts, organosilver salts are particularly preferable.

Example of the organic compounds which can be used for forming organosilver salt oxidizers are the benzotriazoles described, e.g., in U.S. Pat. No. 4,500,626 (columns 52-53), and fatty acids. In addition, the acetylene silver described in U.S. Pat. No. 4,775,613 is also useful. Organosilver salts may be used in combinations of two or more.

Those organosilver salts can be used from 0.01 to 10 moles, and preferably from 0.01 to 1 mole, per mole of light-sensitive silver halide. An appropriate total coverage of light-sensitive silver halide and organosilver salts is from 0.05 to 10 g/m$^2$, and preferably 0.1 to 4 g/m$^2$, based on silver.

Hydrophilic binders are preferable as the binder used in constituent layers of the photosensitive material. Examples of such a binder may make mention of those described in RD, supra, and those described on pages 71–75 of Japanese Patent Application Laid-Open (JP-A) No. 64-13546. Specifically, transparent or translucent hydrophilic binders are preferable, and examples thereof include natural compounds, for example, proteins, such as gelatin and gelatin derivatives; polysaccharides, such as cellulose derivatives, starch, gum arabic, dextran and pulluran; and synthetic high molecular compounds, such as polyvinyl alcohol, polyvinyl pyrrolidone and acrylamide polymers. Further, it is possible to use as the binder the highly water-absorbing polymers described, e.g. in U.S. Pat. No. 4,960,681 and Japanese Patent Application Laid-Open (JP-A) No. 62-245260. More specifically, these polymers are homo- or copolymers of vinyl monomers having —COOM or —$SO_3M$ (wherein M is a hydrogen atom or an alkali metal), such as sodium methacrylate and ammonium methacrylate; and copolymers of a vinyl monomer having the foregoing group and other vinyl monomers (e.g., Sumikagel L-5H, trade name, manufactured by Sumitomo Chemical Co., Ltd.). The binders recited above can be used in combinations of two or more. In particular, it is preferable to combine gelatin with some of the foregoing binders. Lime-processed gelatin, acid-processed gelatin, or delimed gelatin having reduced contents of calcium and the like can be preferably chosen depending on the intended purpose. Also, it is preferable that those gelatins be used in combination.

An appropriate coating amount of a binder in the present invention is preferably 1 to 20 g/$m^2$, and particularly preferably 2 to 10 g/$m^2$.

As a compound (coupler) capable of forming a dye by a coupling reaction with an oxidized product of a developing agent, both four-equivalent couplers and two-equivalent couplers can be used as dye-forming couplers in the present invention. Their anti-diffusing groups (ballast groups) may be in the form of a polymer chain. Specific examples of such couplers are described in detail in T. H. James, The Theory of the Photographic Process, 4th ed., pp. 291–334 and 354–361, and Japanese Patent Application Laid-Open (JP-A) Nos. 58-123533, 58-149046, 58-149047, 59-111148, 59-124399, 59-174835, 59-231539, 59-231540, 60-2950, 60-2951, 60-14242, 60-23474, 60-66249, 8-110608, 8-146552, and 8-146578.

In addition, it is also preferable to use the couplers cited below.

Suitable yellow couplers are the couplers represented by formulae (I) and (II) respectively in EP-502424A1; the couplers represented by formulae (1) and (2) respectively in EP-513496A1; the coupler represented by formula (1) in claim 1 of Japanese Patent Application Laid-Open (JP-A) No. 5-307248; the coupler represented by formula D in column 1, lines 45–55, of U.S. Pat. No. 5,066,576; the coupler represented by formula D in paragraph [00081] of Japanese Patent Application Laid-Open (JP-A) No. 4-274425, the coupler described in claim 1 (page 40) of EP-049838A1; the coupler represented by formula (Y) on page 4 of EP-0447969A1; and the couplers represented by formulae (I) to (IV) in column 7, lines 36–58, of U.S. Pat. No. 4,476,219.

Suitable magenta couplers are the couplers described in Japanese Patent Application Laid-Open (JP-A) Nos. 3-39737, 6-43611, 5-204106 and 4-3626.

Suitable cyan couplers are the couplers described in Japanese Patent Application Laid-Open (JP-A) Nos. 4-204843, and 4-43345.

With regard to the polymeric couplers, suitable ones are couplers described in Japanese Patent Application Laid-Open (JP-A) No. 2-44345.

Couplers which can provide dyes having moderate diffusibility are described in U.S. Pat. No. 4,366,237, British Patent No. 2,125,570, EP-096570, and German Patent No. 3,234,533 are preferable.

Further, the following functional couplers may be incorporated in the photosensitive material used in the present invention.

As couplers capable of correcting unnecessary absorption of dyes, the yellow colored cyan couplers described in EP-456257A1, the yellow-colored magenta couplers described in EP, supra, the magenta-colored cyan couplers described in U.S. Pat. No. 4,833,069; and the colorless masking couplers represented by (2) of U.S. Pat. No. 4,837,136 and Formula (A) in claim 1 of WO 92/11575 (especially, the exemplified compounds on pages 36–45) are examples thereof.

Couplers or other compounds which can release photographically useful compound by reacting with an oxidized product of a developing agent are preferably used.

As the compounds (including couplers) capable of releasing photographically useful compound moiety by the reaction with the oxidized product of a developing agent, examples thereof are development inhibitor releasing compounds, the compounds represented by formulae (I) to (IV) in EP-0378236A1 (p. 11); the compound represented by formula (I) in EP-0436938A2 (p. 7); the compound represented by formula (1) in Japanese Patent Application Laid-Open (JP-A) No. 5-307248; the compounds represented by formulae (I), (II) and (III) in EP-0440195A2 (pp. 5-6); the compound (ligand releasing compound) represented by formula (I) in claim 1 of Japanese Patent Application Laid-Open (JP-A) No. 6-59411; and the compound represented by LIG-X in claim 1 of U.S. Pat. No. 4,555,478.

In the present invention, the amount of coupler contained is preferably 0.01 to 10 g and more preferably 0.1 to 2 g per square meter of a photosensitive material.

In the present invention, it is preferable that a color developing agent which, when oxidized by development to form silver, can produce dyes by-coupling with the above couplers be incorporated in the photosensitive material.

In this case, the combination of a p-phenylenediamine developing agent with a phenol or active methylene coupler, as described in U.S. Pat. No. 3,531,256, and the combination of a p-aminophenol developing agent with an active methylene coupler, as described in U.S. Pat. No. 3,761,270, can be used.

Combinations of sulfonamidophenol with four-equivalent couplers as described in U.S. Pat. No. 4,021,240 and Japanese Patent Application Laid-Open (JP-A) No. 60-128438 are advantageous, because they can have excellent storability when incorporated in a photosensitive material.

In incorporating a color developing agent into a photosensitive material, a precursor thereof may be used. Examples of such a precursor include the indoaniline compounds described in U.S. Pat. No. 3,342,597; the Schiff base type compounds described in U.S. Pat. No. 3,342,599 and RD Nos. 14850 and 15159; the aldol compounds described in RD No. 13924; the metal complexes described in U.S. Pat. No. 3,719,492; and the urethane compounds described in Japanese Patent Application Laid-Open (JP-A) No. 53-135628.

Further, combinations of couplers with the sulfonamidophenol developing agent described in Japanese Patent Application (JP-A) No. 7-180568, and the combinations of couplers with the hydrazine developing agent described in Japanese Patent Application Nos. (JP-A) 7-49287 and 7-63572 are preferably used in the photosensitive material according to the present invention.

In the present invention, compounds represented by general formula I, II, III, or IV are preferably used as developing agents. Of these, compounds represented by general formula I or II are particularly preferably used.

These developing agents are explained in detail below.

Compounds represented by formula (I) are collectively called sulfonamidophenols and are already known in this field. When used in the present invention, it is preferable that at least one of substituents $R_1$ to $R_5$ have a ballast group of 8 or more carbon atoms. In formula (I), each of $R_1$ to $R_4$ represents a hydrogen atom, a halogen atom (e.g., Cl or Br), an alkyl group (e.g., methyl, ethyl, isopropyl, n-butyl, or t-butyl), an aryl group (e.g., phenyl, tolyl, or xylyl), an alkylcarbonamide group (e.g., acetylamino, propionylamino, or butyroylamino), an arylcarbonamide group (e.g., benzoylamino), an alkylsulfonamide group (e.g., methanesulfonylamino or ethanesulfonylamino), an arylsulfonamide group (e.g., benzenesulfonylamino or toluenesulfonylamino), an alkoxy group (e.g., methoxy, ethoxy, or butoxy), an aryloxy group (e.g., phenoxy), an alkylthio group (e.g., methylthio, ethylthio, or buthylthio), an arylthio group (e.g., phenylthio or tolylthio), an alkylcarbamoyl group (e.g., methylcarbamoyl, dimethylcarbamoyl, ethylcarbamoyl, diethylcarbamoyl, dibutylcarbamoyl, piperidylcarbamoyl, or morpholylcarbamoyl), an arylcarbamoyl group (e.g., phenylcarbamoyl, methylphenylcarbamoyl, ethylphenylcarbamoyl, or benzylphenylcarbamoyl), a carbamoyl group, an alkylsulfamoyl group (e.g., methylsulfamoyl, dimethylsulfamoyl, ethylsulfamoyl, diethylsulfamoyl, dibutylsulfamoyl, piperidylsulfamoyl, or morpholylsulfamoyl), an arylsulfamoyl group (e.g., phenylsulfamoyl, methylphenylsulfamoyl, ethylphenylsulfamoyl, or benzylphenylsulfamoyl), a sulfamoyl group, a cyano group, an alkylsulfonyl group (e.g., methanesulfonyl or ethanesulfonyl), an arylsulfonyl group (e.g., phenylsulfonyl, 4-chlorophenylsulfonyl, or p-toluenesulfonyl), an alkoxycarbonyl group (e.g., methoxycarbonyl, ethoxycarbonyl, or butoxycarbonyl), an aryloxycarbonyl group (e.g., phenoxycarbonyl), an alkylcarbonyl group (e.g., acetyl, propionyl, or butyroyl), an arylcarbonyl group (e.g., benzoyl or alkylbenzoyl), or an acyloxy group (e.g., acetyloxy, propionyloxy, or butyroyloxy). Of groups $R_1$ to $R_4$, $R_2$ and $R_4$ are preferably hydrogen atoms. A sum of the Hammett's substituent constant $\sigma_p$ of $R_1$ to $R_4$ is preferably not less than 0. $R_5$ represents an alykl group (e.g., methyl, ethyl, butyl, octyl, lauryl, cetyl, or stearyl), an aryl group (e.g., phenyl, tolyl, xylyl, 4-methoxyphenyl, dodecylphenyl, chlorophenyl, trichlorophenyl, nitrochlorophenyl, triisopropylphenyl, 4-dodecyloxyphenyl, or 3,5-di-(methoxycarbonyl)), or a heterocyclic group (e.g., pyridyl).

The compounds represented by formula (II) are collectively called carbamoylhydrazines. The above two groups of compounds are already known in this field. When used in the present invention, it is preferable that the substituent on the ring or $R_5$ have a ballast group of 8 or more carbon atoms.

In formula (II), Z represents a group of atoms that form an aromatic ring. The aromatic ring formed by Z is required to be sufficiently electrophilic to impart developing activity for forming silver to the compounds represented by formula (II). To meet this requirement, aromatic rings which form a nitrogen-containing aromatic ring or which are prepared by introducing an elecrophilic group into a benzene are preferably used. Examples of such aromatic rings include a pyridine ring, a pyrazine ring, a pyrimidine ring, a quinoline ring, or a quinoxaline ring. Examples of substituents on the benzene ring include an alkylsulfonyl group (e.g., methanesulfonyl or ethanesulfonyl), a halogen atom (e.g., chlorine or bromine), an alkylcarbamoyl group (e.g., methylcarbamoyl, dimethylcarbamoyl, ethylcarbamoyl, diethylcarbamoyl, dibutylcarbamoyl, piperidinecarbamoyl, or morpholinocarbamoyl), an arylcarbamoyl group (e.g., phenylcarbamoyl, methylphenylcarbamoyl, ethylphenylcarbamoyl, or benzylphenylcarbamoyl), a carbamoyl group, an alkylsulfamoyl group (e.g., methylsulfamoyl, dimethylsulfamoyl, ethylsulfamoyl, diethylsulfamoyl, dibutylsulfamoyl, piperidylsulfamoyl, or morpholylsulfamoyl), an arylsulfamoyl group (e.g., phenylsulfamoyl, methylphenylsulfamoyl, ethylphenylsulfamoyl, or benzylphenylsulfamoyl), a sulfamoyl group, a cyano group, an alkylsulfonyl group (e.g., methanesulfonyl or ethanesulfonyl), an arylsulfonyl group (e.g., phenylsulfonyl, 4-chlorophenylsulfonyl, or p-toluenesulfonyl), an alkoxycarbonyl group (e.g., methoxycarbonyl, ethoxycarbonyl, or butoxycarbonyl), an aryloxycarbonyl group (e.g., phenoxycarbonyl), an alkylcarbonyl group (e.g., acetyl, propionyl, or butyroyl), or an arylcarbonyl group (e.g., benzoyl or alkylbenzoyl). Preferably, the sum of the Hammett's constant $\sigma$ of the above-described substituents is 1 or greater.

The compounds represented by formula (III) are collectively called carbamoylhydrazones. The compounds represented by formula (IV) are collectively called sulfonylhydrazines. These two groups of compounds are known in the present technical field. When they are used in the present invention, it is preferred that at least one of $R_5$ to $R_8$ has a ballast group of 8 or more carbon atoms.

In the above formulae, $R_6$ represents an alkyl group (e.g., methyl or ethyl). X represents an oxygen atom, a sulfur atom, a selenium atom, or an alkyl-substituted or aryl-substituted tertiary nitrogen atom, with alkyl-substituted tertiary nitrogen atom being preferable. Each of $R_7$ and $R_8$ represents a hydrogen atom or a substituent (such as one listed above as a substituent for the benzene ring of Z), and $R_7$ and $R_8$ may be mutually joined to form a double bond or a ring.

Of the compounds of formula (I) to (IV), those of (I) and (II) are particularly preferable from the viewpoint of satisfactory raw stock storability.

In the foregoing descriptions, each of $R_1$ to $R_8$ may have a substituent. Examples of substituents include those listed for a benzene ring.

Below are specific examples of the compounds represented by formulae (I) through (IV). The present invention is not, however, intended to be limited by such examples.

D-1

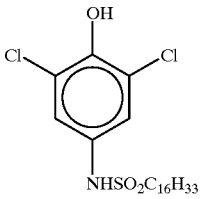

D-2

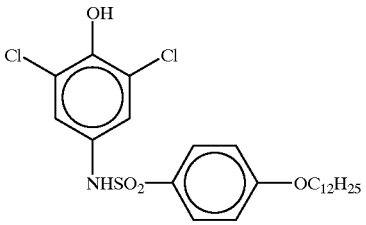

-continued
D-3
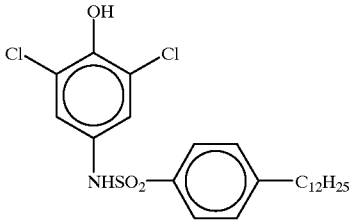
D-4
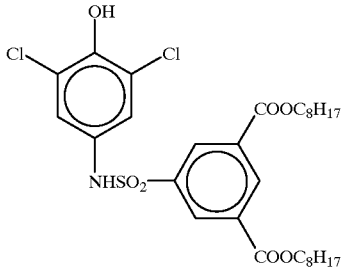
D-5
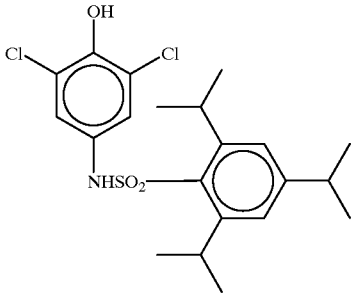
D-6
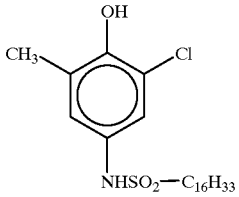
D-7
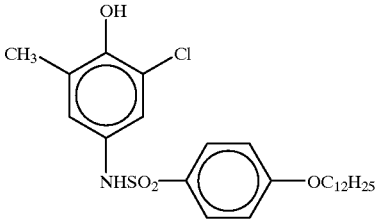
D-8
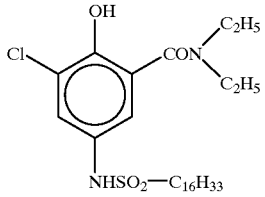
D-9
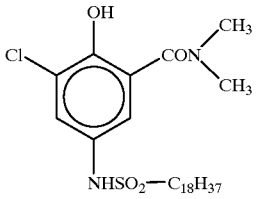
D-10
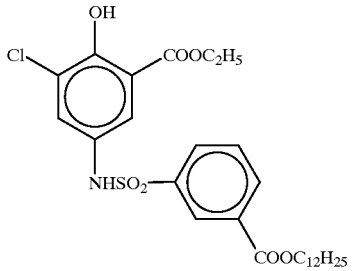
D-11
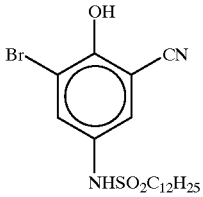
D-12
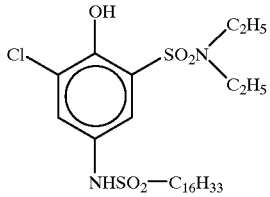
D-13
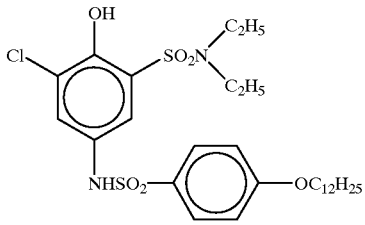
D-14
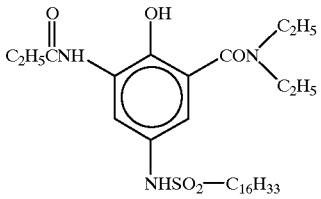

-continued
D-15
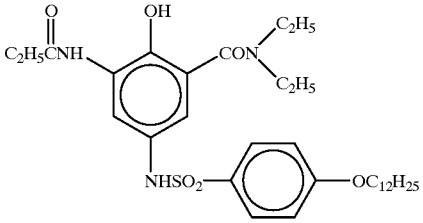
D-16
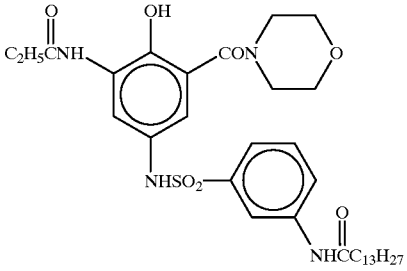
D-17
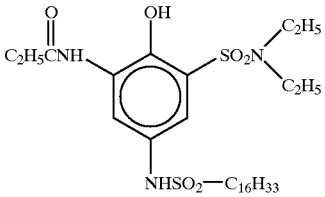
D-18
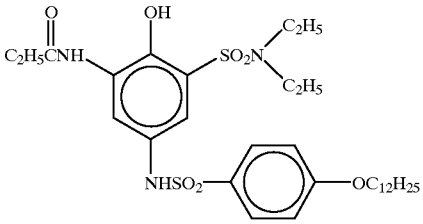
D-19
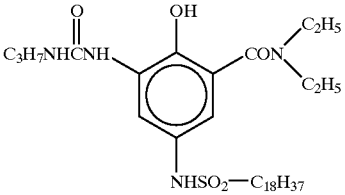
D-20
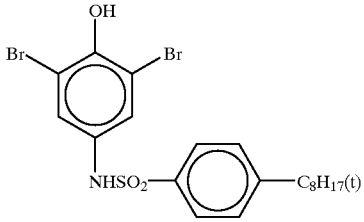
D-21
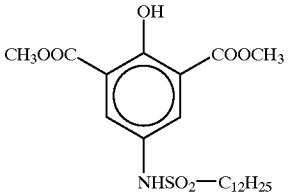
D-22
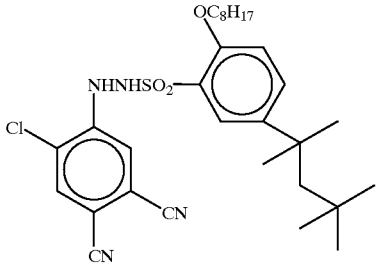
D-23
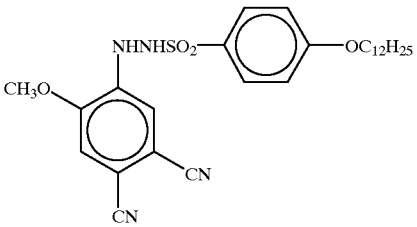
D-24
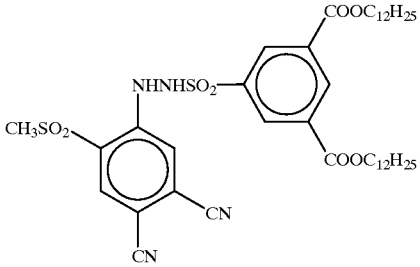
D-25
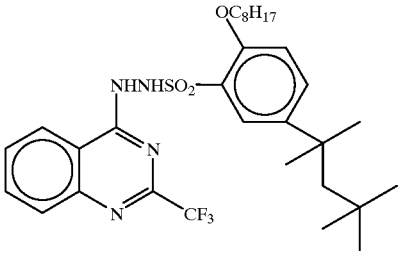
D-26
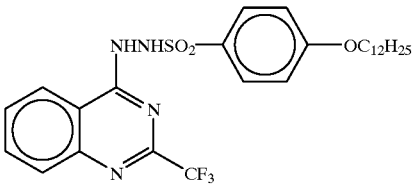

-continued
D-27
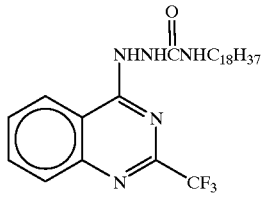
D-28
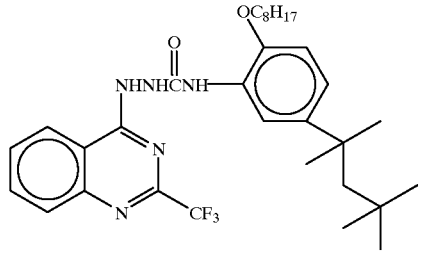
D-29
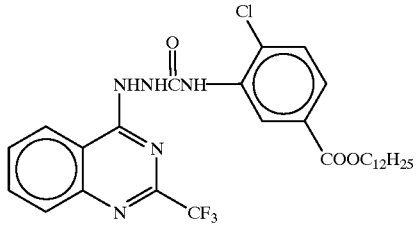
D-30
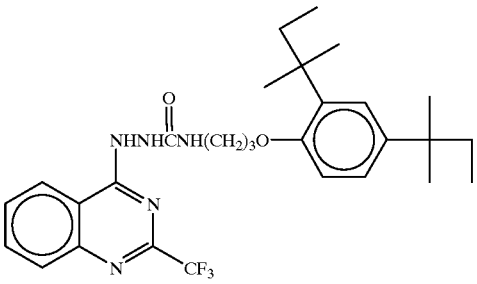
D-31
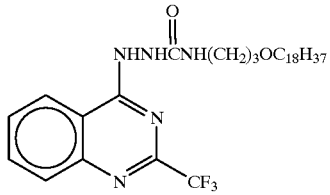
D-32
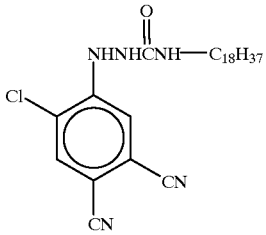
D-33
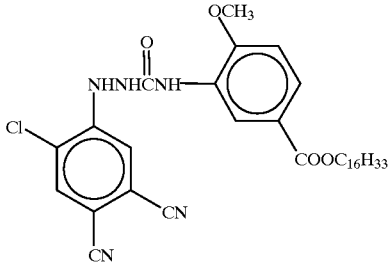
D-34
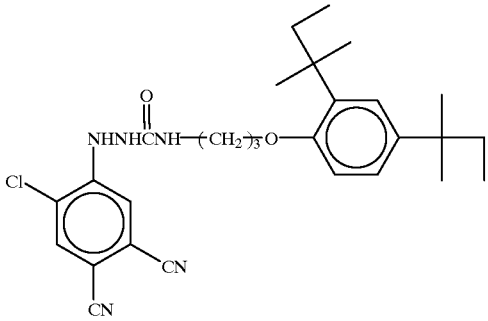
D-35
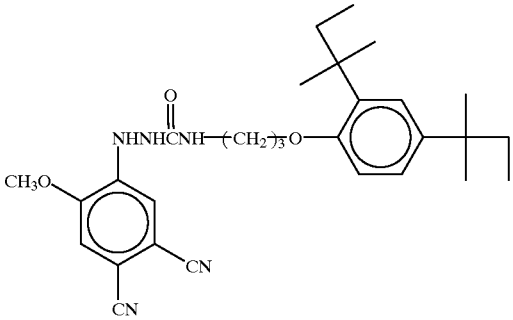
D-36
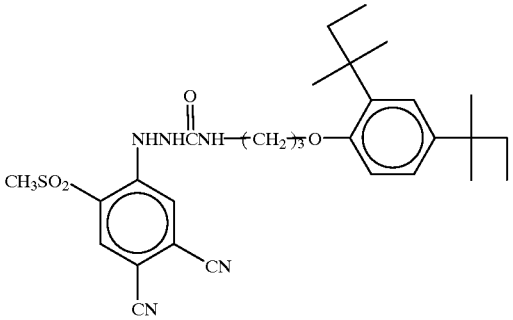

-continued
D-37
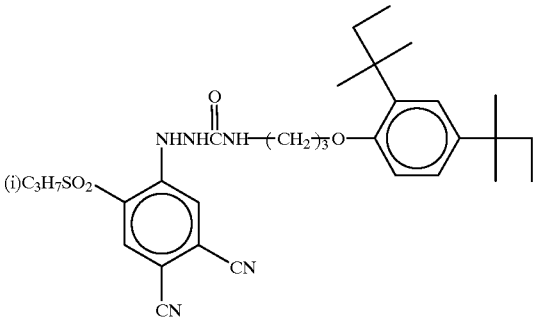
D-38
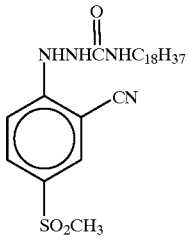
D-39
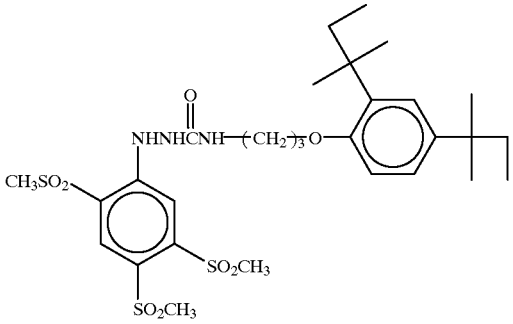
D-40
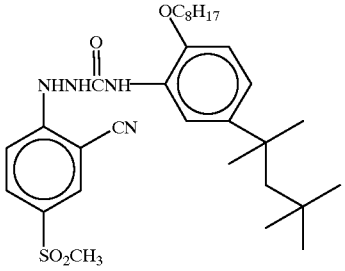
D-41
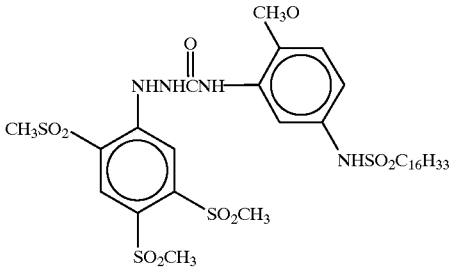
D-42
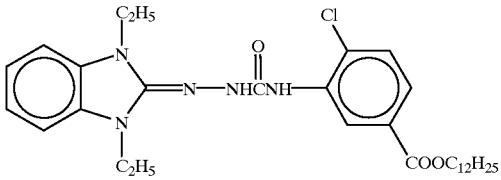
D-43
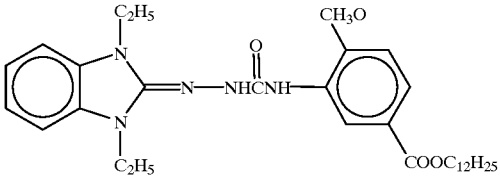
D-44
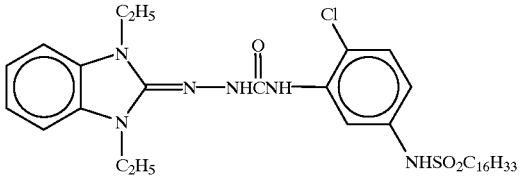
D-45
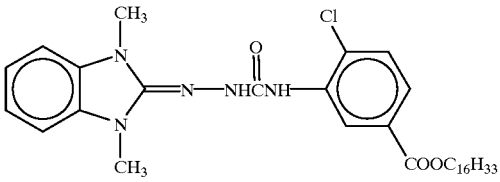
D-46
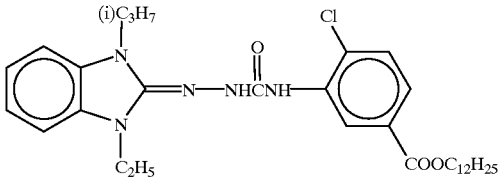
D-47
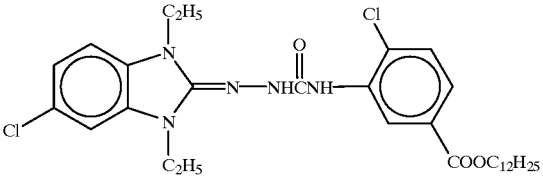
D-48
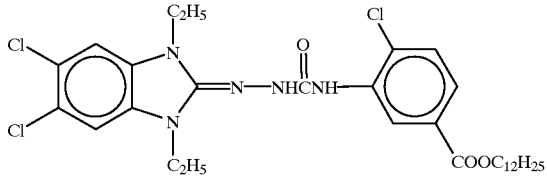

-continued
D-49
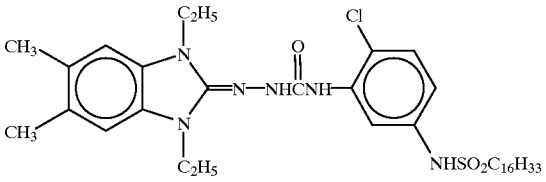
D-50
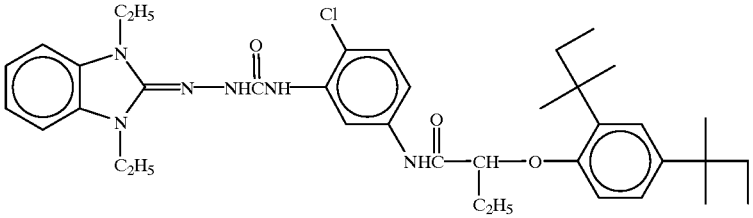
D-51
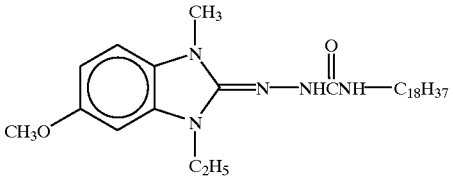
D-52
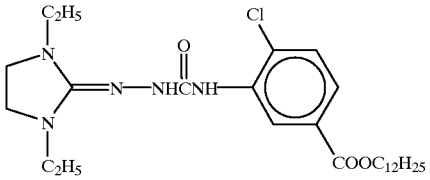
D-53
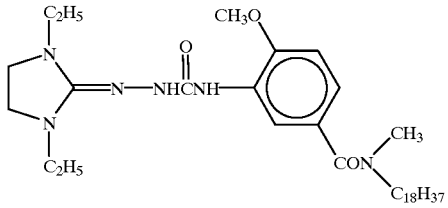
D-54
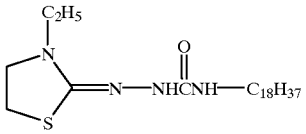
D-55
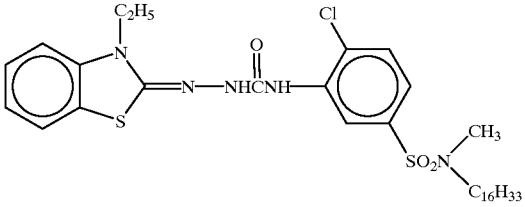
D-56
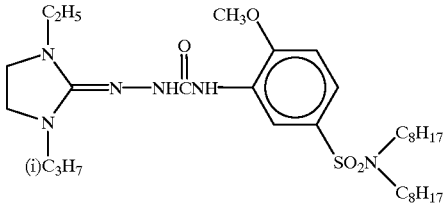
The compounds above can generally be synthesized by using known methods. Some simple synthesis routes are shown below. Synthesis of Developing Agent D-2
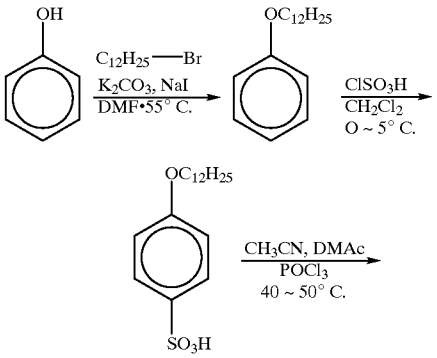
-continued
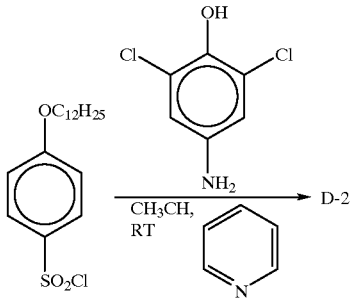

Synthesis of Developing Agent D-27

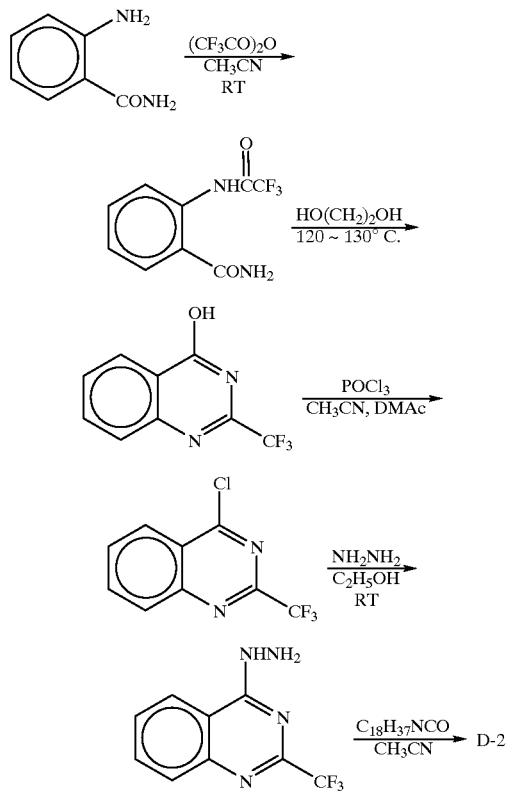

Synthesis of Developing Agent D-42

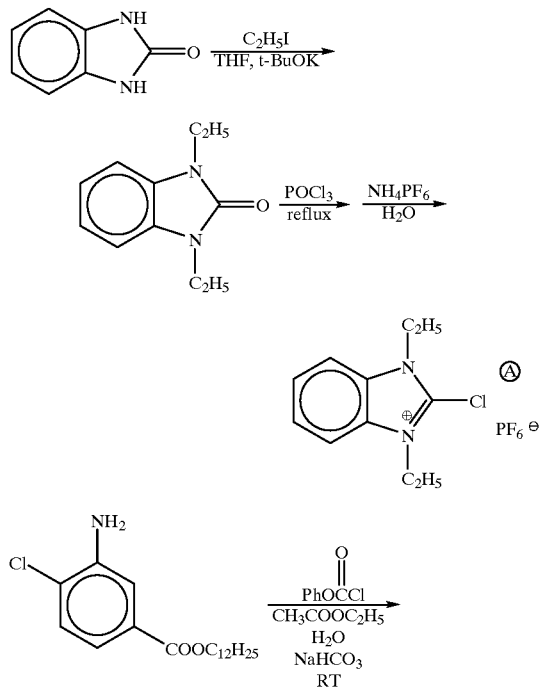

-continued

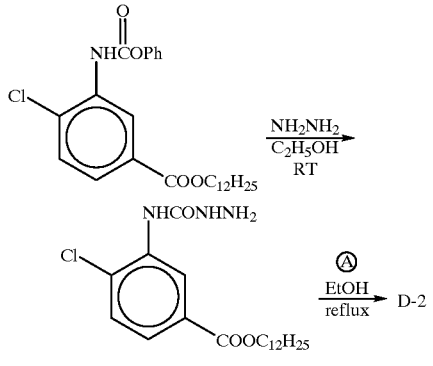

When a nondiffusible developing agent is used, an electron transmitting agent or/and a precursor thereof can optionally be used together therewith in order to promote electron transfer between the nondiffusible developing, agent and a developable silver halide. Particularly, preferable for use are those agents described in U.S. Pat. No. 5,139,919 cited above and EP-0418743A1. Further, it is preferable to adopt methods of introducing such agents stably into layers, as described in Japanese Patent Application Laid-Open (JP-A) Nos. 2-230143 and 2-235044.

The electron transmitting agent its precursor can be selected from the above-mentioned developing agents and their precursors. It is preferable that the mobility of the electron transmitting agent or its precursor exceed that of a nondiffusible developing agent (electron donor). Particularly useful electron transmitting agents are 1-phenyl-3-pyrazolidones or aminophenols.

Further, electron donor precursors such as those described in Japanese Patent Application Laid-Open (JP-A) No. 3-160443 are also preferably used.

Further more, various reducing agents can be used in intermediate layers and protective layers for various purposes, including the prevention of color mixing and the improvement of color reproduction. Such a reducing agent includes, practically speaking, those described in EP-0524649A1 and, 0357040A1 and Japanese Patent Application Laid-Open (JP-A) Nos. 2-249245, 2-46450, and 63-186240. Further, the development inhibitor releasing reducer compounds described in Japanese Patent Application Publication (JP-B) No. 3-63733 and Japanese Patent Application Laid-Open (JP-A) Nos. 1-150135, 2-46450, 2-64634, and 3-43735, and EP-0451833A1 can also be used.

Further, it is possible to use precursors of developing agents which themselves have no reducing power, but can acquire a reducing power when a nucleophilic reagent or heat acts thereon in the development step.

In addition, the reducing agents below can be included in the photosensitive material.

Examples of reducing agents used in the present invention include reducing agents and precursors thereof described in U.S. Pat. Nos. 4,500,626 (columns 49-50), 4,839,272, 4,330,617, 4,590,152, 5,017,454, and 5,139,919; Japanese Patent Application Laid-Open (JP-A) Nos. 60-140335 (pp. 17-18), 57-40245, 56-138736, 59-178458, 59-53831, 59-182449, 59-182450, 60-119555, 60-128436, 60-128439, 60-198540, 60-181742, 61-259253, 62-244044, 62-131253, 62-131256, 64-13546 (pp. 40-57), 1-120553, and EP-0220746A2 (pp. 78–96).

Further, combinations of various reducing agents disclosed in U.S. Pat. No. 3,039,869 may also be used.

Developing agents or reducing agents may be incorporated into the processing sheet described later, but also may be incorporated into photosensitive materials.

In the present invention, the total amounts of the developing agent and the reducing agent are 0.01–20 mole, and preferably 0.1–10 mole, per mole of silver.

In the present invention, four-equivalent couplers or two-equivalent couplers may be suitably selected in accordance with the type of developing agent. By suitably selecting these couplers, color impurity attributed to interlayer transfer of oxidized products of developing agents can be prevented. Specific examples of both types of couplers, i.e., four-equivalent couplers and two-equivalent couplers, are described in detail in "The Theory of the Photographic Process," 4th Ed. Ed. T. H. James, pp. 291–334, 354–361 published by Macmillan (1977); Japanese Patent Application Laid-Open (JP-A) Nos. 58-12353, 58-149046, 58-149047, 59-11114, 59-124399, 59-174835, 59-231539, 59-231540, 60-2951, 60-14242, 60-23474, 60-66249, and other patents and literature listed hereinabove.

Hydrophobic additives such as couplers, developing agents, and nondiffusing reducing agents may be introduced into layers of a photosensitive material by known methods as described in U.S. Pat. No. 2,322,027. In doing so, high-boiling-point organic solvents described in, for example, U.S. Pat. Nos. 4,555,470, 4,536,466, 4,536,467, 4,587,206, 4,555,476, and 4,599,296, or Japanese Patent Application Publication (JP-B) No. 3-62,256 may be used, if necessary, in combination with low-boiling-point organic solvents having a boiling point of 50°–160° C. These dye-forming compounds, nondiffusing reducing agents, and high-boiling-point organic solvents may be used in combinations of two or more species.

The amount of the high-boiling-point organic solvent is not more than 10 g, preferably not more than 5 g, more preferably in the range of 1 g to 0.1 g per g of hydrophobic additive; or 1 cc or less, preferably not more than 0.5 cc, and particularly preferably not more than 0.3 cc or less per g of binder.

Other useful methods include the dispersing methods described in Japanese Patent Application Publication (JP-B) No. 51-39,853 and Japanese Patent Application Laid-Open (JP-A) No. 51-59,943 and methods as described in Japanese Patent Application Laid-Open (JP-A) No. 62-30,242 in which a fine pariculate disperion is added.

When compounds that are substantially insoluble in water are to be incorporated into a binder, the above-described methods may also be used. In addition, a method can be used in which compounds are dispersed in a binder in the form of fine particles.

When a hydrophobic compound is dispersed in a hydrophilic colloid, a variety of surfactants may be used. For example, surfactants described in Japanese Patent Application Laid-Open (JP-A) No. 59-157,636, pp. 37-38, and the above-cited Research Disclosure may be used. Also, phosphate-type surfactants described in Japanese Patent Application Laid-Open (JP-A) Nos. 7-56267, 7-228589, German Patent Application Laid-Open No. 1,932,299A may be used.

In the present invention, photosensitive materials may contain compounds that simultaneously activate development and stabilize images. Specific compounds that are preferred are described in U.S. Pat. No. 4,500,626, columns 51-52.

Between the above-described silver-halide emulsion layers, on the uppemost emulsion layer, or on the lowermost emulsion layer, there may be provided various types of light-insensitive layers such as a protective layer, an undercoat layer, an intermediate layer, a yellow filter layer, and an anti halation layer. Also, various types of auxiliary layers such as a backing layer may be provided on the opposite side of the support. Specifically, there can be provided layer structures as described in the above-mentioned patents; undercoat layers described in U.S. Pat. No. 5,051,335; solid-pigment-containing intermediate layers described in Japanese Patent Application Laid-Open (JP-A) Nos. 1-167, 838 and 61-20,943; intermediate layers containing reducing agents or DIR compounds described in Japanese Patent Application Laid-Open (JP-A) Nos. 1-120,553, 5-34,884, and 2-64,634; intermediate layers containing electron transmitters described in U.S. Pat. Nos. 5,017,454, 5,139,919, and Japanese Patent Application Laid-Open (JP-A) No. 2-235,044; protective layers including reducing agents described in Japanese Patent Application Laid-Open (JP-A) No. 4-249,245; and combinations of these layers.

Dyes that can be used for yellow filter layers and antihalation filters preferably fade during development or dissolve and do not affect the density after processing.

Fading, or removal, of dyes in a yellow filter layer or antihalation layer during development is defined such that the amount of the dye remaining after processing becomes ⅓ or less by weight, preferably 1/10 or less by weight, of the amount immediately before application, and this may be caused by eluting of dye components out of the photosensitive material during development or transferring onto a processing material. Alternatively, dyes may undergo reaction during development and converted to colorless compounds.

Conventional dyes may be incorporated into the phosensitive materials of the present invention. For example, dyes may be used that dissolve in an alkali of a developing solution, and dyes that fade after being reacted with components of a developing solution, i.e., sulfite ions, developing agent, or an alkali.

Specific examples of such dyes include those described in EP-549,489A1 and ExF2-6 dyes described in Japanese Patent Application Laid-Open (JP-A) No. 7-152,129. It is also possible to use a solid dispersion dye as disclosed in Japanese Patent Application Laid-Open (JP-A) No. 8-101487. Although this dye can be used in the case where a photosensitive material is developed with a processing solution, the dye is best used when the photosensitive material is heat-developed by use of a processing sheet.

Also, dyes may be mordanted by mordants. In this case, mordants and dyes known in the field of photography can be used. Examples of such mordants include those described in U.S. Pat. No. 4,500,626 (column 58-59) and Japanese Patent application Laid-open (JP-A) Nos. 61-88256 (pp. 32–41), 62-244043, and 62-244036.

Moreover, it is possible to use a reducing agent and a compound that releases a diffusible dye upon reaction with the reducing agent, so that a mobil dye is released by alkali during development, and are eluted into a processing solution or transferred to a processing sheet for removal. Specific examples thereof are described in U.S. Pat. Nos. 4,559,290 and 4,783,369, EP-220,746A2, Kokai Giho (JIII Journal of technical Disclosure) No. 87-6119, and Japanese Patent Application Laid-Open (JP-A) NO. 8-101487 paragraphs 0080 to 0081.

A leuco dye that loses its color may be used. Specifically, Japanese Patent Application Laid-Open (JP-A) No. 1-150132 discloses a silver halide photosensitive material including a leuco dye whose color has been developed in advance by a color developing agent of organic acid metal salt. A leuco dye and a color developing agent complex fade due to heat or due to reaction with an alkaline agent. Therefore, when the photosensitive material of the present invention is subjected to heat development, the combination of the leuco dye and the color developing agent is preferred.

As the leuco dye, well known leuco dyes can be used. Examples of such a leuco dye are disclosed in Moriga and Yoshida, "Dyes and Chemicals", 9, p. 84, Chemical Product Association; "Dye Handbook," p. 242, Maruzen, (1970); R. Garner, "Reports on the Progress of Appl. Chem." 56, p. 199 (1971), "Dyes and Chemicals", 19, p. 230, Chemical Product Association, (1974); "Coloring Material", p. 62, p. 288 (1989); and "Dye Industry", 32, 208.

As the color developing agent, metal salts of organic acids are preferably used, as well as acidic terra-abla type color developing agent and phenol-formaldehyde resin. Preferred examples of the metal salts of the organic acids include metal salts of salicylic acids, metal salts of phenol-salicylic acid-formaldehyde resin, and metal salts of Rhodan salt and xanthogenate. Zinc is particularly preferred as the metal to be ceased. Among the above-described color developing agents, usable oil-soluble zinc salicylales are disclosed in U.S. Pat. Nos. 3,864,146 and 4,046,941, and Japanese Patent Application Publication (JP-B) No. 52-1327.

The photosensitive material of the present invention is preferably hardened with a hardening agent.

Examples of such a hardening agent include those described in U.S. Pat. Nos. 4,678,739 (column 41) and 4,791,042, and Japanese Patient Application Laid-Open (JP-A) Nos. 59-116,655, 62-245261, 61-18942, and 4-218044. More specifically, there can be mentioned aldehyde type hardening agents (formaldehyde, etc.), aziridine type hardening agents, epoxy type hardening agents, vinylsulfone type hardening agents (N, N'-ethylene-bis (vinylsulfonylacetamide)ethane, N-methylol type hardening agents (dimethylol urea), and boric acid, metaboric acid and polymeric hardening agents (compounds disclosed in Japanese Patent Application Laid-Open (JP-A) No. 62-234,157, etc.)

These hardening agents are used in an amount of 0.01 to 1 g, preferably 0.005 to 0.5 g, per 1 g of a hydrophilic binder.

For the photosensitive material, various types of antifoggants, photographic stabilizing agent, and their precursors can be used. Specific examples thereof include compounds disclosed in the above-mentioned Research Disclosure, U.S. Pat. Nos. 5,089,378, 4,500,627, and 4,614,702; Japanese Patent Application Laid-Open (JP-A) No. 64-13,564 (pp. 7–9, 57–71, and 81–97); U.S. Pat. Nos. 4,775,610, 4,626,500, and 4,983,494; Japanese Patent Application Laid-Open (JP-A) Nos. 62-174,747, 62-239,148, 1-150,135, 2-110,557, 178,650, and RD Vol. 17,643 (1978), pp. 24-25. These compounds are preferably used in an amount of $5\times10^{-6}$ to $1\times10^{-1}$ mol per mol of silver, more preferably $1\times10^{-5}$ to $1\times10^{-2}$ mol per mol of silver.

The photosensitive material of the present invention is placed, after exposure, onto a processing material containing a base and/or a precursor of a base, with water being present between the photosensitive material and the processing material in an amount of 1/10 through 1 times that required to maximally swell the layers of the materials, the resultant assembly being heated to form an image in the photosensitive material.

The present invention achieves its object in the above-described heat development, thereby lowering the load of the environment due to solution development. However, the present invention can be applied to an activator method utilizing an alkaline processing solution, and a method in which images are developed through use of a processing solution containing a development agent/base.

The heat processing of the photosensitive material is well known in the present technical field. Heat development type photosensitive materials, and their processes are described in Shashin Kogaku no Kiso ("Fundamental of Photographic Engineering"), (1970), Corona Publishing Co. Ltd., pp. 553–555; Eizo Joho ("Imaging Information"), p. 40, April (1978); Nabletts Handbook of Photography and Reprography 7th Ed. (Van Nostrand and Reinhold Company), pp. 32-33; U.S. Pat. Nos. 3,152,904, 3,301,678, and 3,392,020, 3,457,075: British Patent Nos. 1131108 and 1167777; and Research Disclosure (RD. No. 17029), pp. 9–15, June (1978).

The activator processing means a processing method in which a color developing agent is included in the photosensitive material, and the photosensitive material is subjected to development process through use of a processing solution that contain no color developing agent. The processing solution used in such a case is characterized in that it does not contain color developing agent that is not usually contained in a developing solution. The processing solution may contain other components (e.g., alkali, auxiliary development agents) Examples of the activator processing are disclosed in EP-545,491A1 and 565,165A1.

Developing methods utilizing processing solutions containing a development agent/base are described in RD. No. 17643 (pp. 28-29), RD. No. 18716 (left column to right column, p. 651), and RD. No. 307105 (pp. 880–881).

Next, a detailed description is given of processing materials and a processing method used for heat development process in the present invention.

In the photosensitive material of the present invention, it is desirable to use a base or its precursor to promote development for forming silver and the dye forming reaction. For base precursors, there are salts formed by bases and organic acids capable of undergoing decarbonation upon heating, and compounds capable of releasing amines by intramolecular nucleophilic substitution reaction, Lossen rearrangement, or Beckmann rearrangement. Specific examples of such precursors of bases are described in U.S. Pat. Nos. 4,514,493 and 4,657,848, and Kochi Gijutsu No. 5, pp. 55–86 (May 22, 1991, Aztec Co. Inc.). As described in EP-210660A1 and U.S. Pat. No. 4,740,445, it is effective to produce a base by using of the combination of a basic metal compound slightly soluble in water with the so-called complexing compound, capable of complexing the metal ion, which constitutes the basic metal compound, in water as a medium.

The base or its precursor is used in an amount of 0.1–20 $g/m^2$, preferably, 1–10 $g/m^2$.

To the photosensitive material of the present invention, a thermal solvent may further be added for the purpose of promoting the heat development. As examples of such a thermal solvent, mention may be made of the polar organic compounds as described in U.S. Pat. Nos. 3,347,675 and 3,667,959. More specifically, amide derivatives (such as benzamide), urea derivatives (such as methyl urea and ethyl urea), the sulfonamide derivatives (such as the compounds described in Japanese Patent Application Publication (JP-B) Nos. 1-40974 and 4-13701), polyol compounds (such as sorbitols) and polyethylene glycols can be used as thermal solvent.

When a thermal solvent used is insoluble in water, it is preferable for the solvent to be used in the form of a solid dispersion. The layer to which a thermal solvent is added may be chosen from light-sensitive layers or light-insensitive layers depending on the intended purpose.

The thermal solvent is added in an amount of 10–500 wt %, and preferably, 20–300 wt %, based on the amount of the binder of the layer to which the thermal solvent is added.

The heating temperature for the heat development step is in the range of about 50° C. to 250° C., and preferably 60° C. to 150° C.

In the present invention, a processing material having a processing layer which contains a base or a base precursor is used in order to supply a base required for a heat development process. In addition to the above, the processing material may be provided with the function of interrupting air at the time of heat development; preventing materials from evaporating from photosensitive material; supplying material for processing purposes other than a base to the photosensitive material; or removing materials (a yellow filter dye or an antihalation dye) which will become unnecessary after development or unwanted components which will result from development. Materials similar to the photosensitive material can be used for a support and a binder of the processing material.

A mordant may be added to the material to be processed for the purpose of eliminating dye or other purposes. A mordant widely known in the field of photography may be used; e.g., mordants as disclosed in U.S. Pat. Nos. 4,500,626 (columns 58-59), Japanese Patent Application Laid-Open (JP-A) Nos. 61-88256 (pp. 32 to 41), 62-244043, and 62-244036. Alternatively, a pigment-acceptable polymer disclosed in U.S. Pat. No. 4,463,079 may also be used, or the mordant may contain a heat solvent as described above.

The processing layer contains a base or a base precursor. Either organic precursors or inorganic precursors may be used, and the foregoing precursor may be used as the base precursor. The amount of base or precursor used is 0.1–20 $g/m^2$, and more preferably 1–10 $g/m^2$.

When the processing material is subjected to heat development, a small amount of water is used to promote development, transfer of materials for processing purposes, or deffusion of unwanted substances. More specifically, the use of water is disclosed in U.S. Pat. Nos. 4,704,245 and 4,470,445, and Japanese Patent Application Laid-Open (JP-A) No. 61-238056. The water may contain inorganic alkali metal salts, organic bases, low-boiling point solvents, surfactants, antifoggants, complex-forming compounds capable of complexing with slightly-soluble metal salts, mildewproofing agents, or antibacterial agents.

Any type of general-use water can be used. Specifically, distilled water, tap water, well water, mineral water, and so on can be used. In the heat development apparatus utilizing photosensitive material and processing material of the present invention, water may be used only once and then discarded, or water may be circulated and used repeatedly. In the latter case, water that contains components eluted from the materials is used. The apparatuses and water described, e.g., in Japanese Patent Application Laid-Open (JP-A) Nos. 63-144,354, 63-144,355, 62-38,460, and 3-210, 555.

Water may be applied to either the photosensitive material or the processing material or to both.

The amount of water used is 1/10 through 1 times that required to maximally swell the layers of the photosenstive material and the processing material (except for backing layers)

In supplying water, the methods described, e.g., in Japanese Patent Application Laid-Open (JP-A) No. 62-253159 (p. 5) and 63-85544 are preferably used. In addition, it is possible to adopt the method in which a solvent previously microencapsulated or made into the form of a hydrate is incorporated into the photosensitive material or the processing material or both.

The temperature of the water to be added is preferably in the range of 30 to 60° C. as disclosed in Japanese Patent Application Laid-Open (JP-A) No. 63-85544.

In a case where heat development is carried out in the presence of a small amount of water, as disclosed in EP-210, 660A1 and U.S. Pat. No. 4,740,445, it is effective to produce a base by combination of a slightly-water-soluble basic metal compound with a compound (hereinafter referred to as complex-forming compound) which can undergo complex-forming reaction using, as medium, water and metal ion constituting the basic metal compound. In terms of raw stock storability, it is preferable to add the slightly-water-soluble basic metal compound to the photosensitive material, and to add the complex-forming compound to the processing material.

A method of heating the photosensitive material during the development process includes methods of bringing the photosensitive material into contact with a heated block or plate, bringing it into contact with a heating plate, a hot presser, a heating roller, a heating drum, a halogen heater, an infrared or far-infrared lamp heater; or passing it through a high-temperature atmosphere.

Methods disclosed in Japanese Patent Application (JP-A) Nos. 62-253159and 61-147244 (p.27) can be applied as a method of superimposing a photosensitive material and a processing material one over the other such that a photosensitive layer and a processing layer are opposite to each other. Apreferable heating temperature is in the range of 70 to 100° C.

Any one of various heat developing apparatuses can be used for the processing of photographic elements of the present invention. For example, heat developers disclosed in the following publications are preferably used: i.e., Japanese Patent Application Laid-Open (JP-A) Nos. 59-75247, 59-177547, 59-181353, 60-18951, Japanese Utility Model Application Laid-Open (JP-U) No. 62-25944, and Japanese Patent Application Laid-Open (JP-A) Nos. 4-277517, 4-243072, 4-244693, 6-164421, and 6-164422.

Further, a commercially available heat developing apparatus is also usable; e.g., Pictrostat 100, Pictrostat 200, Pictrostat 300, Pictrostat 330, Pictrostat 50, Pictrography 3000, and Pictrography 2000 (manufactured by Fuji Photo Film Co., Ltd.).

The photosensitive material and/or the processing sheet of the present invention may have a conductive heat-generating layer as a heating means for use in the heat development. A heating element disclosed in Japanese Patent Application Laid-Open (JP-A) No. 61-145544 can be used as this heating element.

Although it is possible to capture image information without eliminating developed silver and undeveloped silver halide resulting from development in the present invention, images may also be captured after their elimination. For the latter case, there can be employed a means which eliminates the developed silver and the undeveloped silver halide simultaneous with or after development.

To eliminate developed silver from the photosensitive material simultaneous with development or to complex or solubilize silver halide, if a silver oxidizing agent or a rehaloganating agent which acts as a bleaching agent, or a solvent for silver halide which acts as a fixing agent, is contained in the processing material, they can be allowed to react with developed silver or silver halide, respectively, at the time of heat development.

It is also possible to eliminate the developed silver or to complex or solubilize silver halide, the photosensitive member is superposed onto a second member containing a silver oxidizing agent, a rehaloganating agent, or a solvent for silver halide after the completion of the image-forming development of images.

In the present invention, it is preferable to execute the foregoing processing operations to such an extent as to not prevent reading of image information after photographing and image-forming development. Particularly, undeveloped silver halide produces a high degree of haze in a gelatin layer, thereby increasing the density of the image background. It is desirable to eliminate all of or part of the haze from the layer through use of the foregoing complexing agent to reduce or solubilize the silver halide. Further, it is desirable to use tabular grains having a high aspect ratio or containing a high content of silver chloride for the purpose of reducing the haze of the silver halide itself.

A commonly used silver bleaching agent can be arbitrarily used as the bleaching agent capable of being used with the processing material of the present invention. Such a bleaching agent is disclosed in U.S. Pat. Nos. 1,315,464 and 1,946,640, and "Photographic Chemistry," Vol. 2, Ch. 30, Foundation Press, London, England. This bleaching agent effectively oxidizes and solubilizes photographic silver images. Examples of a useful silver bleaching agent contain alkali metal dichromate and alkali metal ferricyanides.

The preferable bleaching agent is soluble in water and comprises ninhydrin, indandione, hexaketocyclohexane, 2, 4-dinitrobenzoic acid, benzoquinone, benzenesulfonic acid, and 2, 5-dinitrobenzoic acid. Further, the preferable bleaching agent includes metallic organic complex: e.g., iron (III) salts of cyclohexyldialkylaminotetraacetic acid, iron (III) salts of ethylenediaminetetraacetic acid, or iron (III) salts of citric acid. A solvent for silver halide capable of containing a processing material (first processing material) for developing the photosensitive material can be used as a fixing agent. Materials such as a binder, a support, and other additives which can be used for a second processing material may be the same as those for the first processing material.

Although the amount of coating should be changed according to the amount of silver contained in the photosensitive member to be superposed, the bleaching agent is used within the range of 0.01 to 10 mol/silver coating (mol) of the photosensitive member. The range is preferably 0.1 to 3 mol/silver coating (mol) of photosensitive member, and, more preferably, 0.1 to 2 mol/silver coating (mol) of photosensitive member.

Publicly-known solvents for silver halide can be used. For example, it is possible to use thiosulfate such as sodium thiosulfate or ammonium thiosulfate; sulfite such as sodium sulfite or sodium hydrogen sulfite; thiocyanate such as potassium thiocyanate or ammonium thiocyanate; thioether compounds as disclosed in Japanese Patent Application Publication No. 47-11386 such as 1, 8-di-3, 6-dithiaoctane, 2, 2'-thiodiethanol, 6, 9-dioxa-3, 12-dithiatetradecane-1, 14-diol; compounds having a 5- or 6-materialed imide ring as disclosed in Japanese Patent Application Laid-Open (JP-A) No. 6-325350 such as uracil or hydantoin; or compounds expressed by the following formula (I) as disclosed in Japanese Patent Application Laid-Open (JP-A) No. 53-144319. Further, meso iomic thiolates of trimethyltriazolium thiolate, disclosed in Analytica Chemica Acta, 248, pp. 604–614 (1991), are also desirable. Moreover, a compound capable of stabilizing silver halide by fixing disclosed in Japanese Patent Application Laid-Open (JP-A) No. 8-69097 can be also used as a solvent for silver halide.

Formula (I)

$$N(R^1)(R^2)-C(=S)-X-R^3$$

wherein X represents sulfur atom or oxygen atom, and $R^1$ and $R^2$ may be the same or different from each other and respectively represent aliphatic groups, aryl groups, or hetero cyclic residues or amino groups. Further, $R^3$ represent an aliphatic or aryl group. $R^1$ and $R^2$ or $R^2$ and $R^3$ may form 5- or 6-membered heterocyclic rings by combination with each other. Moreover, the foregoing solvents for silver halide may be used in combination.

Of the foregoing compounds, sulfite or compounds having a 5- or 6-membered imide ring such as uracil or hydantoin is particularly preferable. Uracil or hydantoin are particularly preferable when these compounds are used as potassium salts.

The content of the total silver halide solvents in the processing layer is from 0.01 to 100 mmol/$m^2$, preferably from 0.1 to 50 mmol/$m^2$, and more preferably from 10 to 50 mmol/$m^2$. The content of the silver halide solvents ranges from 1/20 to 20 times, preferably from 1/10 to 10 times, and particularly preferably from 1/3 to 3 times by molar ratio to the amount of the silver coated on the photosensitive material. The silver halide solvent may be added to a solvent such as water, methanol, ethanol, acetone, dimethylformamide, methylpropyl glycol, etc., or an alkaline or acidic aqueous solution. Alternatively, the silver halide solvent may be added to a coating fluid while being dispersed in the form of fine solid particles.

The physical developing nuclei and the silver halide solvent are contained in the processing material, and the silver halide in the photosensitive material may be solubilized or fixed into the processing layer simultaneously with development.

The physical developing nucleis and soluble silver salts diffused from the photosensitive material are reduced and converted to physically developed silver, and the thus-developed silver is fixed on the processing layer. It is possible to use all the publicly-known physical developing nuclei; e.g., heavy metals such as zinc, mercury, lead, cadmium, iron, chrome, nickel, tin, cobalt, copper, or ruthenium; noble metals such as palladium, platinum, silver, or gold; or colloidal particles of chalcogen compounds such as an sulfur, selenium, or tellurium with these metals. These physical developing nuclei can be formed by reducing corresponding metal ions through use of a reducing agent such as an ascorbic acid, sodium borohydride, or hydroquinone so as to form a metallic colloidal dispersion, or by mixing a solution of water-soluble sulfides, selenides, or tellurides so as to form a water-insoluble colloidal dispersion of metal sulfides, metal selenides, or metal tellurides. These dispersions are preferably formed in a hydrophilic binder such as gelatin. A method of preparing colloidal silver grains is disclosed in U.S. Pat. No. 2,688,601. A desalting method for removing excessive amounts of salt from the dispersion, which is known as a silver halide emulsion preparation method, may be used as required.

A size of the physical developing nuclei is preferably from 2 to 200 nm.

The content of the physical developing nuclei in the processing layer usually ranges from $10^{-3}$ to 100 mg/$m^2$, and more preferably from $10^{-2}$ to 10 mg/$m^2$.

After having been prepared separately, the physical developing nuclei added to the coating fluid. It may also be formed by allowing to react; e.g., silver nitrate with sodium sulfide, or gold chloride with a reducing agent, in the coating fluid containing hydrophilic binder.

A preferably-used physical developing nuclei is silver, silver sulfide, palladium sulfide, etc. In a case where the physically-developed silver transferred to a complexing agent sheet is used as an image, palladium sulfide, silver sulfide, etc., is preferably used since an image having a low minimum density (Dmin) and a high maximum density (Dmax) can be oblained.

The first and second processing materials can have at least one polymerizable timing layer. This polymerizable timing layer can temporarily delay bleaching or fixing reaction until a reaction between desired halide silver, and a dye-donating compound or a developing agent is substantially completed. The timing layer can be formed from gelatin, polyvinyl alcohol, or polyvinyl alcohol-polyvinyl acetate. This timing layer may also be a barrier timing layer as disclosed in, e.g., U.S. Pat. Nos. 4,056,394, 4,061,496, and 4,229,516.

The timing layer is applied to the processing materials into a layer thickness from 5 to 50 microns, and more preferably from 10 to 30 microns.

In the present invention, in order to bleach and fix the developed photosensitive material through use of the second processing material, the photosensitive material or the second processing material are provided with an amount of water in an amount of 0.1 to 1 times that required for maximally swelling the overall coated layers of both the photosensitive material and the second processing material, excluding their backing layers. Thereafter, the photosensitive member is superposed on the second processing material such that the photosensitive layer is opposite the processing layer. They are heated for a period of from 5 to 60 seconds at a temperature of 40 to 100° C.

The amount and type of water, a method of supplying water, and a method of superposing the photosensitive material on the processing material can be those used for the first processing material.

More specifically, bleach-fixing sheets disclosed in Japanese Patent Application Laid-Open (JP-A) No. 59-136733, U.S. Pat. No. 4,124,398, and Japanese Patent Application Laid-Open (JP-A) No. 55-28098 can be used.

The photosensitive material may contain various surfactants for a wide variety of purposes; for instance, use of the surfactant as a coating aid, improvements in sheet separation, improvements in lubricity, prevention of electrification, promotion of development, etc. Specific examples of such surfactants are described, e.g., in Kochi Gijutsu No. 5, pp. 136–138 (Mar. 22, 1991, Aztec Co. Ltd.,), and Japanese Patent Application Laid-Open (JP-A) Nos. 62-173463 and 62-183457.

The photosensitive material may contain organic fluoro-compounds for preventing lubricity or electrification and for improving sheet separation. Typical examples of the organic fluoro-compounds include fluorine-based surfactants as disclosed in Japanese Patent Application Publication (JP-B) No. 57-9053 (columns 8 to 17), Japanese Patent Application Laid-Open (JP-A) Nos. 61-20944 and 62-135826, or hydrophobic fluorine-containing compounds including oily fluorinated compounds such as fluorine-containing oils, or solid fluorine-containing compound resins such as a tetrafluoroethylene resin.

The photosensitive material preferable has lubricity. A lubricant-containing layer is preferably provided on both the photosensitive layer side and the backing layer side. An appropriate lubricity for the photosensitive material ranges from 0.01 to 0.25, expressed in terms of coefficient of kinematic friction. The aforesaid range of this coefficient is the value determined under a condition in which a photosensitive material is conveyed at a speed of 60 cm/min. (in an atmosphere of 25° C., 60% RH) as a stainless steel ball having a diameter of 5 mm is brought into contact therewith. Even when the material to be brought in contact is replaced by a photosensitive layer surface in the foregoing evaluation, the value obtained is almost the same as the above range.

As examples of usable lubricant, mention may be made of polyorganosilaxanes, higher fatty acid amides, metal salts of higher fatty acids, and esters of higher fatty acid and higher alcohols. Examples which can be used as the polyorganosiloxanes include polydimethylsiloxane, polydiethylsilozane, polystyrylmethylsilioxane, polymethylphenylsiloxane, etc. Such lubricants are preferably added to the outermost layer of the emulsion layer or a backing layer. In particular, polydimethylsiloxane or esters having a long-chain alkyl group are preferred as lubricant.

The present invention preferably employs an antistatic agent; e.g., carboxylic acids and carboxylates; polymers containing sulfonates; cationic polymers; and ionic surface active compounds.

Most suitable antistatic agents include at least one type of crystalline metal oxide selected from the group consisting of ZnO, $TiO_2$, $SnO_2$, $Al_2O_3$, $In_2O_3$, $SiO_2$, MgO, BaO, $MoO_3$, and $V_2O_5$, having a volume resistivity of $10^7$ ohm cm or less and preferably $10^5$ ohm cm or less, and having a particle size of 0.001 to 1.0 μm; fine particles of composite oxides of these metal oxides (Sb, P, B, In, S, Si, and C); and fine particles of sol-state metal oxides or their composite oxides. The content of the antistatic agent in the photosensitive material desirably ranges from 5 to 500 mg/m$^2$, and particularly desirably from 10 to 350 mg/m$^2$. An appropriate ratio of conductive crystalline oxides or its composite oxides to a binder preferably ranges from 1/300 to 100/1, and more preferably from 1/100 to 100/5.

The photosensitive material or the processing sheet (including a backing layer) can contain various polymer latexes for improving physical properties of a layer, such as dimensional stabilization, prevention of curling, prevention of adhesion, prevention of cracking, or prevention of sensitization or desensitization due to application of pressure. Specifically, it is possible to use any one of polymer latexes described in Japanese Patent Application Laid-Open (JP-A) Nos. 62-245258, 62-136648, 62-110066, etc. Particularly, if a polymer latex having a low glass transition point (a 40° C. or less) is used for a mordanting layer, it is possible to prevent the mordanting layer from cracking. In contrast, if a polymer latex having a high glass transition point is used for the backing layer, a curling-prevention effect is produced.

The photosensitive material of the present invention preferably contains a matting agent. The matting agent may be added to either the emulsion-side surface or the backing layer surface. However, the matting agent is particularly preferably provided on the outermost layer of the emulsion-side surface. The matting agent may be either soluble in a processing solution or insoluble in the same. Preferably, both types of matting agents are used in combination. Examples of preferable matting agents include polymethylmethacrylate particles, polymethylmethacrylate/methacyrlic acid (=9/1 or 5/5 molar ratio) copolymer particles, or polystyrene particles. They preferably have a particle size ranging from 0.8 to 10 μm, and extent of distribution of particle sizes is preferably narrow. More specifically, 90% or more of the total number of particles preferably range between 0.9 and 1.1 times as large as a mean particle size. In order to improve a matting effect, it is also favorable to simultaneously add fine particles having a size of 0.8 μm or less. Examples of the fine particle include polymethylemethacrylate grains (0.2 μm), polymetylmethacrylate/methacrylic acid (9/1 molar ratio) copolymer particles (0.3 μm), polystyrene particles (0.25 μm), or colloidal silica (0.03 μm).

A specific example of the matting agent is described in Japanese Patent Application Laid-Open(JP-A) No. 61-88256 (p. 29). Further examples of the matting agent include compounds described in Japanese Patent Application Laid-Open(JP-A) Nos. 63-274944 and 63-274952 such as benzoguanamine resin beads, polycarbonate resin beads, and AS resin beads. The compounds described in Research Disclosure, supra, can be also employed.

Supports for the photosensitive material and the processing sheet are chosen from those which can withstand processing temperatures. In general, photographic supports, including various types of paper and synthetic polymer films, as described in Shashin Kogaku no Kiso—Gin-en Shashin Hen ("Fundamentals of Photographic Engineering—Volume on Silver Salt Photography"), pp. 223–240, compiled by the Japanese Photographic Society, published by Corona Publishing Co., Ltd., in 1979, can be used. Specific examples of such photographic supports include films of polyethylene terephthalate, polyethylene naphthalate, polycarbonate, polyvinyl chloride, polystyrene, polypropylene, polyimide and celluloses (e.g., triacetyl cellulose).

These films can be used alone, or a film laminated with a synthetic polymer such as polyethylene on one side or both sides can be used as a support.

Other supports which can be employed are those described, e.g., in Japanese Patent Application Laid-Open (JP-A) Nos. 62-253159 (pp. 29–31), 161236 (pp. 14–17), 63-316848, 2-22651, 3-56955, and U.S. Pat. No. 5,001,033.

In particular, the supports described in Japanese Patent Application Laid-Open (JP-A) Nos. 6-41281, 6-43581, 6-51426, 6-51437, 6-51442, 6-82961, 6-82960, 6-123937, 6-82959, 6-67346, 6-118561, 6-266050, 6-202277, 6-175282, 6-118561, 7-219129, and 7-219144 can be appropriate for the photosensitive material because of their excellent anticurling properties.

Also, the support constituted mainly of a syndiotactic styrene polymer can preferably be used.

In order to adhere a constituent layer of a photosensitive material to a support, the support surface is preferably treated. Examples of such a surface activation treatment include chemical teatment, mechanical treatment, corona discharge treatment, flame treatment, ultraviolet-ray treatment, microwave treatment, glow discharge treatment, active plasma treatment, laser treatment, mixed acid treatment, and ozone oxidation treatment. Of these treatments, ultraviolet-ray treatment, flame treatment, corona discharge treatment, and glow discharge treatment are preferred.

Undercoating may be provided in a single layer or two or more layers. Binders for use in an undercoat layer include copolymers whose starting materials are monomers selected from a group consisting of vinyl chloride, vinylidene chloride, butadiene, methacrylic acid, acrylic acid, itaconic acid, and maleic anhydride, and polyethyleneimine, epoxy resin, grafted gelatin, nitrocellulose and gelatin. Compounds for swelling a support are resorcin and p-chlorophenol. Gelatin hardeners for use in a undercoat layer include chromium salts (such as chromium alum), aldehydes (such as formaldehyde and glutaraldehyde), isocyanates, active halide compounds (such as 2,4-dichloro-6-hydroxy-s-triazine), epichlorohydrin resins, and active vinylsulfonic compounds. $SiO_2$, $TiO_2$, inorganic particles, or polymethyl methacrylate copolymer particles (0.01 to 10 $\mu$m) may be contained in an undercoat layer as a matting agent.

Preferably, a support having a magnetic recording layer, as described in Japanese Patent Application Laid-Open (JP-A) Nos. 4-124645, 5-40321, 6-35092, and 6-317875 is used to thereby record photographic information and the like.

A magnetic recording layer is coated on a support by applying an aqueous coating solution or a coating solution containing in an organic solvent wherein magnetic particles are dispersed in binders.

Magnetic particles usable in the present invention include ferromagnetic iron oxides such as $\gamma$—$Fe_2O_3$, Co-deposited $\gamma$—$Fe_2O_3$, Co-deposited magnetite, ferromagnetic chromium dioxide, ferromagnetic metals, ferromagnetic alloys, hexagonal-system Ba ferrite, Sr ferrite, Pb ferrite, and Ca ferrite. Magnetic particles used in the present invention are preferably Co-deposited ferromagnetic iron oxides such as Co-deposited $\gamma$—$Fe_2O_3$. Magnetic particles may be in any shape, for example, acicular, rice grain, spherical, cubic, and tabular. The specific surface area of magnetic particles is preferably 20 $m^2/g$ or more, and particularly preferably 30 $m^2/g$ or more of $S_{BET}$. The saturation magnetization ($\sigma s$) of a ferromagnetic body is preferably $3.0\times10^4$ to $3.0\times10^5$ A/m, and particularly preferably $4.0\times10^4$ to $2.5\times10^5$ A/m. Ferromagnetic particles may be surface-treated with silica and/or alumina, or with organic substances. Also, magnetic particles may be surface-treated with a silane coupling agent or a titanium coupling agent as described in Japanese Patent Application Laid-Open (JP-A) No. 6-161032. Alternatively, magnetic particles coated with an inorganic or organic substance as described in Japanese Patent Application Laid-Open (JP-A) Nos. 4-259911 and 5-81652 may be used.

Binders used with magnetic particles include a thermoplastic resin, thermosetting resins, radiation-setting resins, reactive resins, acid-degradable, alkali-degradable, or biodegradable polymers, natural polymers (cellulose derivatives, sugar derivatives, etc.), and their mixtures as described in Japanese Patent Application Laid-Open (JP-A) No. 4-219569. These resins have −40° C. to 300° C. of Tg and a weight average molecular weight of 2,000 to 1,000,000. Examples of these resins include vinyl copolymers; cellulose derivatives, such as cellulose diacetate, cellulose triacetate, cellulose acetate propionate, cellulose acetate butylate, cellulose tripropionate; acrylic resins; and polyvinyl acetal resins. Gelatin is also preferred. Cellulose di(tri) acetate is particularly preferred. Binders can be cured through addition of epoxy type, aziridine type, or isocyanate-type cross-linking agents. Isocyanate type cross-linking agents include isocyanates such as tolylensdiisocyanate, 4,4'-diphenylmethauediisocyanate, hexamethylenediisocyanate and xylilene; reaction products of these isocyanates with polyalcohols (for example, reaction product of 3 moles of tolylenediisocyanate with 1 mole of trimethylol propane; and polyisocyanates formed by condensation of these isocyanates. These are described, for example, in Japanese Patent Application Laid-Open (JP-A) No. 6-59357.

The aforementioned magnetic substances are preferably dispersed into the above-recited binders using a kneader, a pin-type mill, an annular-type mill, or the like, as described in Japanese Patent Application Laid-Open (JP-A) No. 6-35092. These apparatuses for dispersing use may also preferably be used in combination. The dispersing agents as recited in Japanese Patent Application Laid-Open (JP-A) No. 5-088283 and other known dispersing agents are usable. The thickness of the magnetic recording layer is 0.1 $\mu$m to 10 $\mu$m, preferably 0.2 $\mu$m to 5 $\mu$m, and more preferably 0.3 $\mu$m to 3 $\mu$m. The weight ratio of magnetic particles to a binder is preferably from 0.5:100 to 60:100, and more preferably from 1:100 to 30:100. The coating amount of magnetic particles is 0.005 to 3 $g/m^2$, preferably 0.01 to 2 $g/m^2$, and more preferably 0.02 to 0.5 $g/m^2$. The transmission yellow density of the magnetic recording layer is preferably 0.01 to 0.50, more preferably 0.03 to 0.20, and particularly preferably 0.04 to 0.15. The magnetic recording layer may be formed on the back surface of a photographic support by coating or printing over the entire surface thereof or in stripes. A magnetic recording layer may be coated by means of an air doctor, a blade, an air knife, squeezing impregnation, a reverse roller, a transfer roller, gravure, kiss impression casting, spraying, dipping, a bar, extrusion, etc., and the coating liquid described in Japanese Patent Application Laid-Open No. 5-341436 is preferable.

Various functions may be given to the magnetic recording layer. Examples of such functions are for improved lubrication, curl adjustment, antistatic properties, adhesion preventing, and head polishing. Alternatively, another functional layer having such functions may be added. At least one type of particles is preferably abrasives of nonspherical inorganic particles having a Mohs scale hardness of not less than 5. Nonspherical inorganic particles preferably comprise powder of oxide such as aluminum oxide, chromium oxide, silicon dioxide, or titanium dioxide, powder of carbide such as silicon carbide or titanium carbide, or powder of diamond. These abrasives may be surface-treated with a silane coupling agent or a titanium coupling agent. These particles may be added to the magnetic recording layer, or the magnetic recording layer may be overcoated with these particles (for example, a protective layer or a lubricant layer) . The aforementioned binders can be used, and the same binders used for the magnetic recording layer are preferably used. A photosensitive material having a magnetic recording layer is described in U.S. Pat. Nos. 5,336,589, 5,250,404, 5,229,259, and 5,215,874, and EP-466,130.

Preferred polyester support for use in a photosensitive material having the above-described magnetic recording layer will be described hereinafter. For details, including photosensitive materials, processing, cartridges, and embodiments, refer to Kokai Giho (JIII Journal of Technical Disclosure) No. 94-6023 (Hatsumei Kyokai, Mar. 15, 1994). A preferred polyester support contains diol and aromatic dicarboxylic acid as essential components. Examples of aromatic dicarboxylic acid include 2,6-, 1,5-, 1,4-, and 2,7-naphthalene dicarboxylic acids, terephthalic acid, isophthalic acid, and phthalic acid. Examples of diol include diethylene glycol, triethylene glycol, cyclohexanedimethanol, bisphenol A, and bisphenol. Examples of their homopolymers include polyethylene terephthalate, polyethylene naphthalate, and polycyclohexanedimethanol terephthalate. A polyester support is particularly preferably of polyester which contains 50 to 100 mol % of 2,6-naphthalene dicarboxylic acid, and most preferably of polyethylene 2,6-naphthalate. The average molecular weight ranges from approximately 5,000 to 200,000. The Tg of polyester is 50° C. or more, and preferably 90° C. or more.

In order to suppress a tendency to curl, a polyester support is heat-treated at a temperature ranging from 40° C. or more to lower than Tg, and preferably from (Tg−20° C.) or more to lower than Tg. A polyester support may be heat-treated at a fixed temperature or while being cooled, within these temperature ranges. Heat-treatment time is 0.1 to 1,500 hours, preferably 0.5 to 200 hours. A support may be heat-treated either in a rolled form or while being transferred in a web form. Roughness may be provided on the surface of a support (e.g., through coating with conductive inorganic particles, such as $SnO_2$ or $Sb_2O_5$), to thereby improve the surface properties of a support. It is desirable to knurl the end portion of a support in order to slightly raise the end portion above the remaining portion, to thereby prevent an opening in a core portion from being transferred onto the support. The heat treatment may be performed in any step after formation of a support, surface treatment, formation of a back layer (coating with an antistatic agent, a lubricant, etc.), and undercoating, preferably after coating with an antistatic agent.

An ultraviolet-ray absorbing agent may be added to this polyester through kneading. Also, in order to prevent light pumping, dyes or pigments marketed for polyester use may be added. Examples of such a dye or pigment include Diaresin manufactured by Mitsubishi Chemical Industries, Ltd., and Kayaset and the like manufactured by Nippon Kayaku Co., Ltd.

Next is described film cassettes capable of loading a photosensitive material. A main material for cassettes used in the present invention may be metal or synthetic plastic.

Preferable plastic materials for cassettes include polystyrene, polyethylene, polypropylene, and polyphenyl ether. Cassettes may contain any of a variety of antistatic agents, preferably carbon black, metal oxide particles, nonionic, anionic, cationic, or betaine surfactants or polymers. Antistatic-treated cassettes are described in Japanese Patent Application Laid-Open (JP-A) Nos. 1-312537 and 1-312538. Particularly, the resistance of cassettes is preferably not more than $10^{12}$ ohms at 25° C. and 25% RH. Ordinary plastic cassettes are made of plastic kneaded with carbon black and pigments for imparting light shielding property thereto. The cassette size may be size 135 of current use, or in order to cope with the trend toward reducing camera size, a cassette diameter of 25 mm (size 135) of current use may be reduced to 22 mm or less. The volume of a cassette shell is not more than 30 $cm^3$, preferably not more than 25 $cm^3$. The weight of plastic used for a cassette or a cassette shell is preferably 5 to 15 g.

Film cassettes may be structured such that a film is fed forward to the exterior thereof by rotating a spool, or such that the leading end of a film loaded therein is fed forward to the exterior thereof through the passageway port portion thereof by rotating a spool shaft in the firm-forward direction. Examples of such a structure are disclosed in U.S. Pat. Nos. 4,834,306 and 5,226,613.

Images recorded in the above-described color photosensitive materials may be printed onto color papers and heat development type photosensitive materials by the methods as described in Japanese Patent Application Laid-Open (JP-A) Nos. 5-241251, 5-19364, and 5-19363.

EXAMPLES

The present invention will next be described by way of examples, but these examples should not be construed as limiting the invention in any way.

Example 1

(1) Preparation of Emulsions:

Tabular silver iodobromide emulsion 1-A (Comparative emulsion)

Step A: 1,400 cc of an aqueous solution containing 19 g of gelatin and 6.2 g of KBr was stirred while being maintained at 45° C. 70 cc of an aqueous 1M $AgNO_3$ solution and an 70cc of aqueous 1M KBr solution were simultaneously added in double jets over a 45-second period. After the temperature of the mixture was elevated to 70° C., 24 g of gelatin was added, and the resultant mixture was ripened for 25 minutes. 243 cc of an aqueous 2M $AgNO_3$ solution and 226 cc of an aqueous 2M KBr solution were added over a 15-munute period while accelerating the flow rate (the flow rate at the end of addition was 2.5 times that at the start) and pAg was maintained at 8.0.

Step B: The temperature of the emulsion was then lowered to 55° C., 50 cc of an aqueous 1M $AgNO_3$ solution and 120 cc of an aqueous 0.3M KI solution were added to the emulsion at a constant flow rate over a 3-minute period. Next, 457 cc of an aqueous 1.8M $AgNO_3$ solution and 447 cc of an aqueous 1.8M KBr solution were added to the emulsion.

Next, the emulsion was cooled to 35° C. and washed by a customary method such as flocculation. The emulsion was mixed with 75 g of gelatin and adjusted to a pH of 5.5 and pAg of 8.2.

Tabular grains having a mean grain size of 0.43 $\mu$m were obtained.

The same applies to emulsions 1-B through 1-F below.

Tabular Silver Iodobromide Emulsion 1-B (Comparative Emulsion)

This emulsion was prepared the same as emulsion 1-A with the following exception:

In step A, 243 cc of an aqueous 2M $AgNO_3$ solution and 226 cc of an aqueous 2M KBr solution were added over a 15-minute period while accelerating the flow rate (the flow rate at the end of addition was 2.5 times that at the start), and pAg was maintained at 8.3, instead maintainory pAg at 8.0.

Tabular Silver Iodobromide Emulsion 1-C (Emulsion of the Present Invention)

This emulsion was prepared the same as emulsion 1-A with the following exception:

In step B, instead of adding 120 cc of an aqueous 0.3M KI solution at a constant flow rate over a 3-minute period, 150 cc of an aqueous 0.3M KI solution was added similarly.

Tabular Silver Iodobromide Emulsion 1-D (Emulsion of the Present Invention)

This emulsion was prepared the same as emulsion 1-C with the following exception:

In step B, instead of adding 150 cc of an aqueous 0.3M KI solution at a constant flow rate over a 3-minute period, 150 cc of an aqueous 0.1M KI solution was added over a 6-minute period.

Tabular Silver Iodobromide Emulsion 1-E (Emulsion of the Present Invention)

This emulsion was prepared the same as emulsion 1-D with the following exception:

In step B, the emulsion was lowered to 45° C. instead of 55° C.

Tabular Silver Iodobromide Emulsion 1-F (Emulsion of the Present Invention)

This emulsion was prepared the same as emulsion 1-E with the following exception:

In step A, 243 cc of an aqueous 2M $AgNO_3$ solution and 226 cc of an aqueous 2M KBr solution were added over a 15-minute period while accelerating the flow rate (the flow rate at the end of addition was 2.5 times that at the start) while pAg was maintained at 8.3, instead of maintaining pAg at 8.0.

(2) Chemical Sensitization

Emulsions 1-A through 1-F were subjected to spectral sensitization and chemical sensitization by addition of spectral sensitizing dye, Compound I, potassium thiocyanate, chloroauric acid, and sodium thiosulfate at 60° C., a pH of 6.2, and pAg of 8.4. At this time, the amount of the spectral sensitizing dye was changed in proportion to the surface area of grains of the respective emulsion, and the amount of chemical sensitizer was adjusted to maximize the sensitivity of the emulsion for an exposure of 1/100 sec.

Sensitizing dye I for green-sensitive emulsions

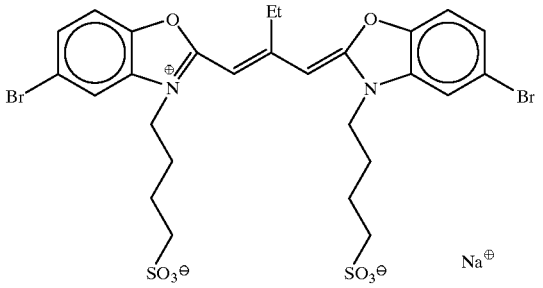

$6.3\times10^{-4}$ mol/mol silver for Emulsion 1-A

Sensitizing dye II for green-sensitive emulsions

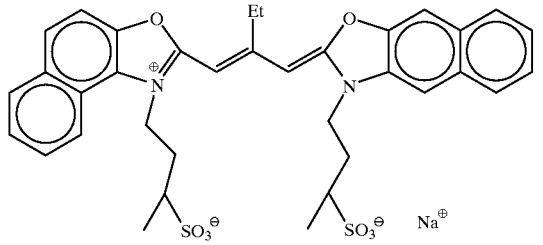

$1.6\times10^{-4}$ mol/mol silver for Emulsion 1-A

Sensitizing dye III for green-sensitive emulsions

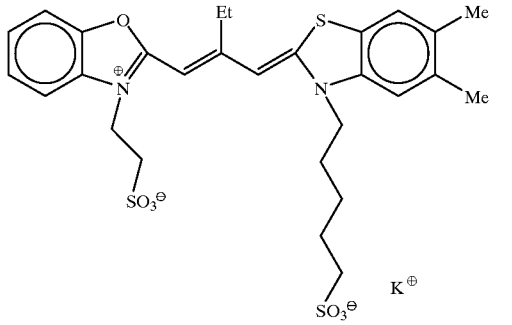

$2.4\times10^{-5}$ mol/mol silver for Emulsion 1-A Compound I

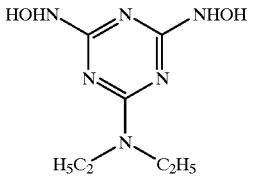

(3) Preparation and Evaluation of Dispersions and Coated Samples

A dispersion of zinc hydroxide for use as a base precursor a was prepared.

31 g of a zinc hydroxide powder with a primary particle size of 0.2 μm was mixed with dispersing agents; namely, 1.6 g of carboxymethylcellulose, 0.4 g of sodium polyacrylate, 8.5 g of lime-treated ossein gelatin, and 158.5 ml of water. This mixture was dispersed over a 1-hour period by a mill employing glass beads. After the dispersion of the mixture, the glass beads were filtered, whereby 188 g of dispersion of zinc hydroxide was obtained.

Further, an emulsion dispersion of a magenta coupler was prepared.

7.80 g of a magenta coupler (a), 5.45 g of a developing agent (b), 2 mg of an antifoggant (c), 8.21 g of a high-boiling-point organic solvent (d), and 24.0 ml of ethyl acetate were dissolved at 60° C. The thus-dissolved solution was mixed with 150 g of aqueous solution into which 12.0 g of lime-treated gelatin and 0.6 g of sodium dodecylbenzene sulfonate were dissolved. The mixture was then emulsified and dispersed over a 20-minute period at 10,000 rpm through use of a dissolver. Distilled water was added to the mixture so that the total volume of the mixture became 300 g, and the mixture was further mixed over a 10-minute period at 2,000 rpm.

Magenta Coupler (a)

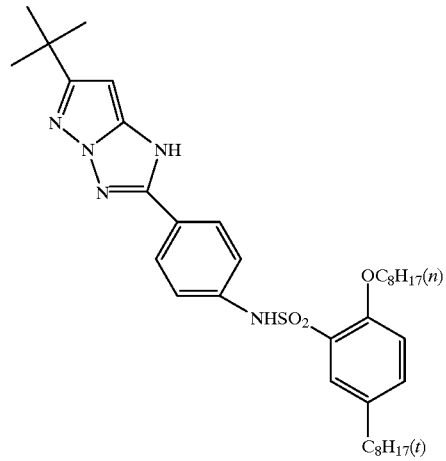

Developing Agent (b)

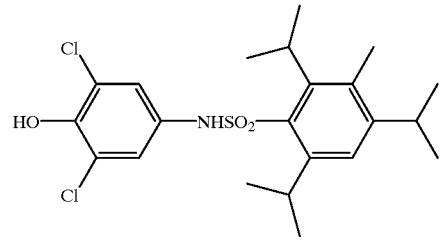

Antifoggant (c)

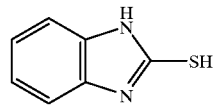

High-boiling-point Organic Solvent (d)

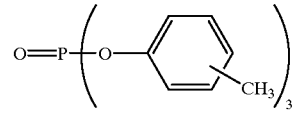

-continued

Surfactant (e)

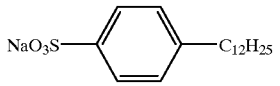

The thus-prepared dispersion and emulsions 1-A through 1-F were applied in combination to a support so as to yield a composition shown in Table 1, so that single-layer heat-development color photosensitive materials of samples 101 through 106 were made.

TABLE 1

| | | Samples 101–106 |
|---|---|---|
| Protective layer | Lime-treated gelatin | 1,000 |
| | Matting agent (silica) | 50 |
| | Surfactant (f) | 100 |
| | Surfactant (g) | 300 |
| | Water-soluble polymer (h) | 15 |
| | Hardening agent (i) | 35 |
| Intermediate layer | Lime-treated gelatin | 375 |
| | Surfactant (g) | 15 |
| | Zinc hydroxide | 1,100 |
| | Water-soluble polymer (h) | 15 |
| Magenta color-developing layer | Lime-treated gelatin | 2,000 |
| | Emulsion (one of 1-A to 1-F) (converted to the amount of silver coated) | 1,726 |
| | Magenta coupler (a) | 637 |
| | Developing agent (b) | 444 |
| | Anti foggant (c) | 0 |
| | High-boiling point-organic solvent (d) | 670.00 |
| | Surfactant (e) | 33 |
| | Water-soluble polymer (h) | 14 |
| Transparent PET base (120 μm) | | |

*Numerals represent the amount of coating (mg/m$^2$).

Processing material P-1 as shown in Tables 2 and 3 was also made.

TABLE 2

Structure of Processing Material P-1

| Layer structure | Material added | Amount (mg/m$^2$) |
|---|---|---|
| 4th layer: Protective layer | Acid-treated gelatin | 220 |
| | Water-soluble polymer (j) | 60 |
| | Water-soluble polymer (k) | 200 |
| | Additive (l) | 80 |
| | Palladium sulfide | 3 |
| | Potassium nitride | 12 |
| | Matting agent (m) | 10 |
| | Surfactant (g) | 7 |
| | Surfactant (n) | 7 |
| | Surfactant (o) | 10 |
| 3rd layer: Intermediate layer | Lime-treated gelatin | 240 |
| | Water-soluble polymer (k) | 24 |
| | Hardening agent (p) | 180 |
| | Surfactant (e) | 9 |
| 2nd layer: Base-generating layer | Lime-treated gelatin | 2,400 |
| | Water-soluble polymer (k) | 360 |
| | Water-soluble polymer (q) | 700 |
| | Water-soluble polymer (r) | 600 |
| | High boiling point solvent (s) | 2,000 |
| | Additive (t) | 20 |
| | Potassium hidantoin | 260 |
| | Guanidin picolate | 2910 |
| | Potassium quinolate | 225 |
| | Sodium quinolate | 180 |
| | Surfactant (e) | 24 |
| 1st layer: Undercoat layer | Lime-treated gelatin | 280 |
| | Water-soluble polymer (j) | 12 |
| | Surfactant (g) | 14 |
| | Hardening agent (p) | 185 |
| Transparent support A (63 μm) | | |

TABLE 3

Structure of Support A

| Layer | Composition | Weight (mg/m$^2$) |
|---|---|---|
| Surface undercoat layer | Gelatin | 100 |
| Polymer layer | Polyethylene terephthalate | 62,500 |
| Backface undercoat layer | Methyl methacrylate-styrene-2-ethylhexylacrylate-methacrylic acid copolymer | 1,000 |
| | PMMA latex | 120 |
| | (av. particle size: 12 μm) | |
| | | 63,720 |

Surfactant (f)

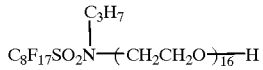

Surfactant (g)

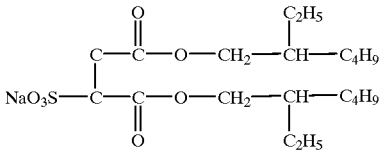

TABLE 3-continued

Structure of Support A

Water-soluble Polymer (h)

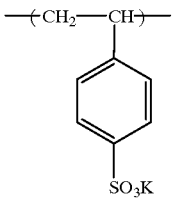

Hardening Agent (i)

$CH_2{=}CH{-}SO_2{-}CH_2{-}SO_2{-}CH{=}CH_2$

Water-soluble Polymer (j) K-carageenan

Water-soluble Polymer (k) Sumikagel L-5H (produced by Sumitomo Chemical Co., Ltd.)

Additive (1)

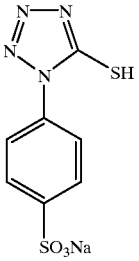

Matting Agent (m)

SYLOID 79 (produced by Fuji Davison)

Surfactant (n)

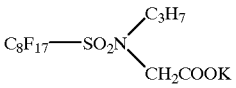

Surfactant (o)

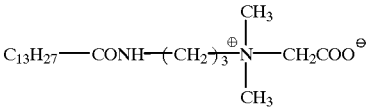

Hardener (p)

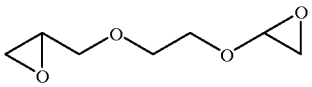

Water-soluble polymer (q)

Dextran (molecular weight: $7 \times 10^4$)

Water-soluble Polymer (r)

MP Polymer MP102 (produced by Kraray Co., Ltd.)

High-boiling-point solvent (s) Paraffin 40 (produced by Ajinomoto)

Additive (t)

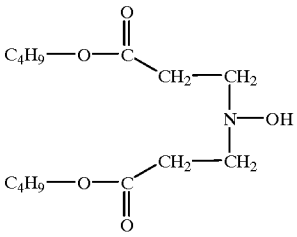

This photosensitive material was exposed to light at 1000 lux over a period of 1/100 second through an optical wedge and a green filter.

Water at a temperature of 40° C. was applied in an amount of 15 ml/m$^2$ to the surface of the exposed photosensitive material. The photosensitive material was brought into face-to-face contact with a processing material. The thus-superposed film was subjected to heat development for 30 seconds at 83° C. through use of a heating drum. The photosensitive material was peeled from the processing material after the development, so that a magenta-colored wedge-shaped image was obtained. This sample was further subjected to treatment in a second process through use of a second processing sheet provided below.

TABLE 4

Structure of Processing Material P-2

| Layer structure | Material added | Amount ($mg/m^2$) |
|---|---|---|
| 4th layer: Protective layer | Acid-treated gelatin | 220 |
| | Water-soluble polymer (j) | 60 |
| | Water-soluble polymer (k) | 200 |
| | Additive (1) | 80 |
| | Palladium sulfide | 3 |
| | Potassium nitride | 12 |
| | Matting agent (m) | 10 |
| | Surfactant (g) | 7 |
| | Surfactant (n) | 7 |
| | Surfactant (o) | 10 |
| 3rd layer: Intermediate layer | Lime-treated gelatin | 240 |
| | Water-soluble polymer (k) | 24 |
| | Hardening agent (p) | 180 |
| | Surfactant (e) | 9 |
| 2nd layer: Fixing layer | Lime-treated gelatin | 2,400 |
| | Water-soluble polymer (k) | 360 |
| | Water-soluble polymer (q) | 700 |
| | Water-soluble polymer (r) | 600 |
| | Compound A | 4,000 |
| | Surfactant (e) | 20 |
| 1st layer: Undercoat layer | Lime-treated gelatin | 280 |
| | Water-soluble polymer (j) | 12 |
| | Surfactant (g) | 14 |
| | Hardening agent (p) | 185 |
| Transparent support | A (63 μm) | |

Compound A

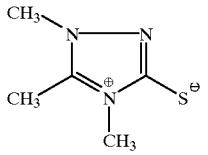

In the processing of the second process, 10 $cc/m^2$ of water was applied to the second processing sheet, and this sheet was superposed onto the photosensitive material which had finished undergoing the first treatment. The sheet was heated at 60° C. for 30 seconds. Transmission density of color-developed samples of this sheet was measured, whereby so-called characteristic curves were obtained. A relative sensitivity was determined by the reciprocal of the amount of exposure corresponding to a density of 0.15 higher than a fog density. Sensitivity was represented with reference to the value of sample 101, which was taken as 100.

To examine the granularity of the sample, the sample was exposed such that the magenta color density became 1.0. Color-developed pieces were prepared by carrying out the same heat development. The RMS granularity of the color-developed pieces was measured at an aperture having a diameter of 48 μm through use of a diffused light source.

The reciprocals of the thus-measured RMS values were represented in the form of relative values with reference to the value of the sample 101, which was taken as 100.

The sample was tested with regard to pressure resistance according to test method A below.

The sample was then exposed to light to provide characteristic curves in a similar manner to the previously-described manner and subjected to heat development similar to the previously-described heat development.

Test Method A

The photosensitive material was placed in an atmosphere of a 55% RH for more than three hours, and then a load of 4 g was exerted on the photosensitive material in the same atmosphere through use of a needle having a size (diameter) of 0.1 mm. The surface of the emulsion layer of the photosensitive material was scratched by the needle at a speed of 1 cm/sec.

The densities of loaded and unloaded areas of the developed sample were measured through a measurement slit of 5 microns ×10 mm.

An increment in fog due to a pressure is taken as ΔFog.

Within the range of exposure, which is 100 times as large as E0 producing a density of 0.15 above fog density of a pressure-desensitized region is represented by ((logE2−logE1)/2)*100 (%) when density is reduced due to pressure in an amount exceeding 0.01 from exposure E1 to exposure E2.

In order to compare the heat-developed photosensitive materials with those developed by solution development with regard to pressure resistance, the photosensitive materials were exposed to light in a manner similar to that described above and developed at 38° C. for 165 seconds through use of a color negative film processor CN-16. The densities of the color-developed samples were measured in the same way as described above.

For each emulsion, a ratio of tabular silver halide having an aspect ratio of 2 through 30 to the total projection area of all silver halide grains was measured by photographing according to a replica method using transmission electron microscope.

To obtain the ratio (number) of grains containing more than 10 dislocation lines per grain to all grains, dislocation lines were observed every 200 emulsion grains through use of a high-voltage electron microscope (each grain was observed at five inclination angles of the microscope with reference to the sample; namely, −10°, −5°, 0°, 5°, and 10°).

Results are shown in Table 5.

TABLE 5

| | | | | | | Pressure resistance | | Pressure resistance (Liquid development) | | |
|---|---|---|---|---|---|---|---|---|---|---|
| Sample No. | Emulsion | AgX Ratio*1 (%) | AgX Ratio*2 (%) | Sensitivity | RMS Granularity | ΔFog | Pressure-desensitized area (%) | ΔFog | Pressure-desensitized area (%) | Remarks |
| 101 | 1-A | 47 (AAR:2.6) | 46 | 100 | 100 | 0.27 | 5 | 0.18 | 25 | Compara. Example |
| 102 | 1-B | 65 (AAR:3.5) | 40 | 105 | 100 | 0.28 | 5 | 0.19 | 23 | Compara. Example |
| 103 | 1-C | 65 (AAR:3.5) | 66 | 117 | 104 | 0.14 | 5 | 0.15 | 28 | Invention |
| 104 | 1-D | 65 (AAR:3.5) | 78 | 120 | 108 | 0.10 | 5 | 0.10 | 33 | Invention |
| 105 | 1-E | 65 (AAR:3.5) | 88 | 126 | 108 | 0.08 | 5 | 0.08 | 36 | Invention |

TABLE 5-continued

| Sample No. | Emulsion | AgX Ratio*1 (%) | AgX Ratio*2 (%) | Sensitivity | RMS Granurality | Pressure resistance ΔFog | Pressure resistance Pressure-desensitized area (%) | Pressure resistance (Liquid development) ΔFog | Pressure resistance (Liquid development) Pressure-desensitized area (%) | Remarks |
|---|---|---|---|---|---|---|---|---|---|---|
| 106 | 1-F | 47 (AAR:4.0) | 60 | 105 | 102 | 0.21 | 5 | 0.19 | 24 | Compara. Example |

*1Ratio of tabular AgX grains having an aspect ratio of 2–30 to the total projection area of all AgX grains
*2Ratio of AgX grains containing 10 dislocation lines per grain to the entire grains
AAR: Average aspect ratio
Compara. Example: Comparative Example Samples containing the emulsion of the present invention; i.e., an emulsion in which 50 through 100% of the entire projection region of all silver halide grains is occupied by tabular silver halide grains having an aspect ratio of 2 to 30, and, in which the silver halide containing tabular grains having more than 10 dislocation lines per grain occupy 50 through 100% of all grains in number, can provide samples which have been improved in granularity, sensitivity and pressure characteristics.

Example 2

Single-layer heat-development-type color photosensitive materials of samples 201 though 204 were prepared in completely the same way as those of Example 1 with the exception of use of the following emulsions 2-A through 2-D in lieu of the emulsions employed in Example 1. The thus-prepared samples were evaluated in the same way as those of Example 1.

Preparation of Emulsions:

Tabular Silver Iodobromide Emulsion 2-A (Comparative Emulsion:

Step A: 1600 cc of an aqueous solution containing 7.5 g of gelatin and 4.3 g of KBr was agitated while being maintained at 40° C. 41 cc of an aqueous 1.2M $AgNO_3$ solution and 41 cc of an aqueous 1.4M KBr/KI solution containing 12 mol % of KI were simultaneously added to the foregoing aqueous solution over a period of 40 seconds by a double jet method. After 36 g of gelatin was added to the resultant aqueous solution, the aqueous solution was heated to 58° C. 36 cc of an aqueous 0.4M $AgNO_3$ solution was added to the heated aqueous solution, followed by the addition of ammonia. The aqueous solution was ripened for 15 minutes and then was neutralized with acetic acid. Further, 782 cc of an aqueous 1.9M $AgNO_3$ solution and 700 cc of an aqueous 1.9M KBr solution were added to the previous aqueous solution over a period of 17 minutes while accelerating the flow rate (the flow rate at the end of addition was 4.2 times that at the start) and pAg was maintained at 8.4. Next, the emulsion was cooled to 35° C. and washed by a customary flocculation method. The emulsion was mixed with 49 g of gelatin and was adjusted to a pH of 5.5 and pAg of 8.8. The resultant emulsion contained 1.2 mol of silver and 65 g of gelatin per Kg. Tabular grains having a size of 0.27 $\mu$m were obtained.

Step B: 1,150 cc of an aqueous solution containing 30 g of the above-described emulsion as a seed emulsion, 33 g of gelatin, and 1.2 g of KBr was agitated while maintained at 75° C. 387 cc of an aqueous 1.8M $AgNO_3$ solution and 427 cc of an aqueous 1.6M KBr/KI solution containing 10 mol % of KI were added to the previous aqueous solution over a period of 38 minutes by double jets while accelerating flow rate (the flow rate at the end of addition was 3.3 times that at the start).

Step C: The temperature of the emulsion was then lowered to 55° C. 30 cc of an aqueous 1M $AgNO_3$ solution and 100 cc of an aqueous 0.3M KI solution were added to the emulsion at a constant flow rate over a period of three minutes. Next, an aqueous KBr solution was added to the emulsion to thereby adjust pAg to 9.1. 194 cc of a 2M $AgNO_3$ solution and 165 cc of a 2.2M KBr solution were added to the emulsion.

Next, the emulsion was cooled to 35° C. and washed by a customary flocculation method. The emulsion was mixed with 75 g of gelatin and adjusted to a pH of 5.5 and pAg of 8.9.

Tabular grains having an average sphere-equivalent grain diameter of 0.86 microns were obtained.

The same applies to emulsions 2-B through 2-E hereinbelow.

Tabular Silver Iodobromide Emulsion 2-B (Comparative Emulsion):

This emulsion was prepared the same as emulsion 2-A with the following exception:

In step B, instead of adding 387 cc of an aqueous 1.8M $AgNO_3$ solution and 427 cc of an aqueous 1.6M KBr/KI solution containing 10 mol % KI, 387 cc of an aqueous 1.8M $AgNO_3$ solution and 427 cc of an aqueous 1.6M KBr/KI solution containing 3 mol % KI were added over a period of 38 minutes using double jets while accelerating the flow rate (the flow rate obtained at the end of addition was 3.3 times that at the start).

Tabular Silver Iodobromide Emulsion 2-C (Emulsion of the Present Invention)

This emulsion was prepared the same as emulsion 2-B with the following exception:

In step C, instead of adding 30 cc of an aqueous 1M $AgNO_3$ solution and 100 cc of an aqueous 0.3M KI solution at a constant flow rate over a period of three minutes, 100 cc of an aqueous 0.3M $AgNO_3$ solution and 834 cc of an aqueous 0.04M KI solution were added over a period of 10 minutes at a constant flow rate.

Tabular Silver Iodobromide Emulsion 2-D (Emulsion of the Present Invention)

This emulsion was prepared the same as the emulsion 2-C with the following exception:

In step B, the emulsion was lowered to 40° C. instead of 55° C.

Results are shown in Table 6.

TABLE 6

| Sample No. | Emulsion | AgX Ratio*1 (%) | AgX Ratio*2 (%) | Sensitivity | RMS Granurality | Pressure resistance ΔFog | Pressure resistance Pressure-desensitized area (%) | Pressure resistance (Liquid development) ΔFog | Pressure resistance (Liquid development) Pressure-desensitized area (%) | Remarks |
|---|---|---|---|---|---|---|---|---|---|---|
| 201 | 2-A | 80 (AAR:4.5) | 35 | 100 | 100 | 0.35 | 10 | 0.24 | 32 | Compara. Example |
| 202 | 2-B | 98 (AAR:5.0) | 48 | 107 | 95 | 0.30 | 10 | 0.22 | 36 | Compara. Example |
| 203 | 2-C | 98 (AAR:5.0) | 65 | 120 | 105 | 0.18 | 12 | 0.17 | 40 | Invention |
| 204 | 2-D | 98 (AAR:5.0) | 81 | 126 | 105 | 0.15 | 12 | 0.15 | 48 | Invention |

*1Ratio of tabular AgX grains having an aspect ratio of 2–30 to the total projection area of all AgX grains
*2Ratio of AgX grains containing 10 dislocation lines per grain to the entire grains
AAR: Average aspect ratio
Compara. Example: Comparative Example As is evident from the results shown in Table 6, samples using the emulsions of the present invention had improved granularity at a high sensitivity and improved pressure resistance.

Example 3

Emulsions 2-A through 2-D prepared in Example 2 were used for a high-sensitivity layer of a magenta-dye-forming layers. Multi-layered coated samples were prepared using emulsions A through G for other than the high-sensitivity layer of the magenta-dye-forming layers, which were prepared in the same way as that described in Examples 1 and 2 for preparing emulsions containing tabular grains and adjusted in grain size, and by using blue-sensitive and red-sensitive emulsions which were prepared by changing the spectral sensitizing dyes to the dyes below.

Sensitizing Dye IV for Blue-Sensitive Emulsion

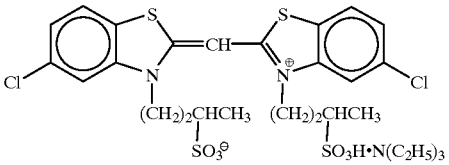

Sensitizing Dye V for Red-Sensitive Emulsion

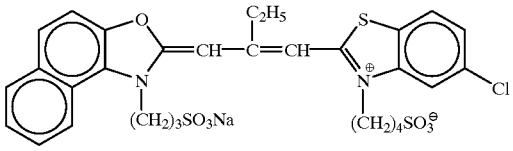

-continued

Sensitizing Dye VI for Red-Sensitive Emulsion

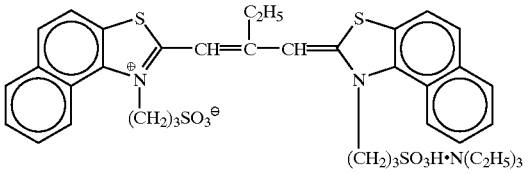

Sensitizing Dye VII for Red-Sensitive Emulsion

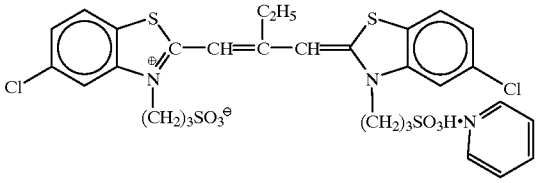

Mixture ratio of V:VI:VII=40:2:58 (molar ratio) Table 7 lists emulsions A through F.

TABLE 7

| | Average AgI contents (%) | Average grain dia. (μm) | Variation coefficient of grain dia. (%) | Ratio of diameter/thickness | Silver ratio [core/int./shell] (AgI contents) | Grains structure and shape |
|---|---|---|---|---|---|---|
| Emulsion A | 6.3 | 1.07 | 22 | 4.0 | [2/63/35] (1/7/6) | Tabular grains of triple structure |
| Emulsion B | 8.8 | 0.64 | 20 | 5.2 | [7/64/29] (0/10/8) | Tabular grains of triple structure |
| Emulsion C | 3.7 | 0.37 | 15 | 2.6 | [5/30/65] (0.5/0/5) | Tabular grains of |

TABLE 7-continued

| | Average AgI contents (%) | Average grain dia. (μm) | Variation coefficient of grain dia. (%) | Ratio of diameter/ thickness | Silver ratio [core/int./shell] (AgI contents) | Grains structure and shape |
|---|---|---|---|---|---|---|
| | | | | | | triple structure |
| Emulsion D | 4.7 | 0.86 | 20 | 5.0 | [3/64/33] (1/3/9) | Tabular grains of triple structure |
| Emulsion E | 5.4 | 0.65 | 20 | 5.4 | [1/68/31] (0/2/13) | Tabular grains of triple structure |
| Emulsion F | 3.7 | 0.49 | 17 | 3.2 | [5/35/60] (0/0/6) | Tabular grains of triple structure |

Further, dispersions of cyan and yellow couplers were prepared according to the method of preparing dispersions of the coupler for Example 1.

To form coloring layers which can be decolored during of heat development, dispersions of coloring agents from combination of leuco dyes and zinc complexes for yellow, magenta, and cyan were also prepared.

Compounds used in the preparation are given below.

Yellow Coupler (u)

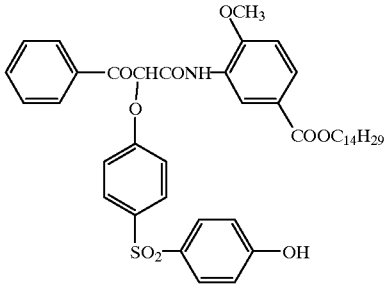

Developing Agent (v)

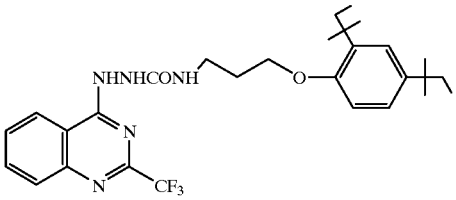

Antifoggant (w)

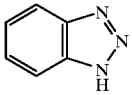

Cyan Coupler (aa)

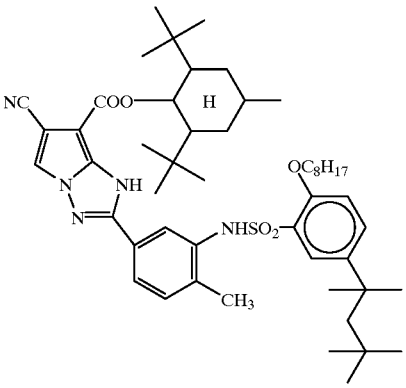

-continued

Leuco Dye (ab)

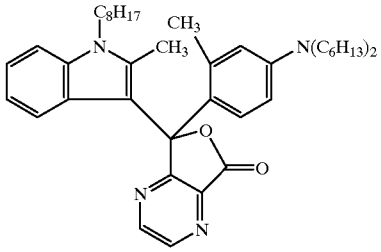

Yellow-Dye-Forming Leuco Dye (x)

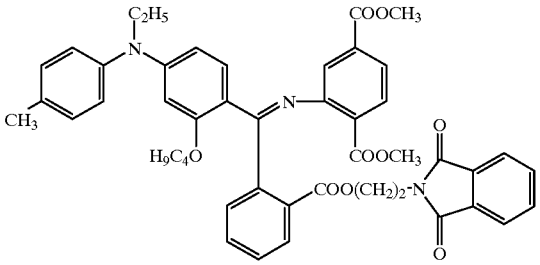

Developer (y)

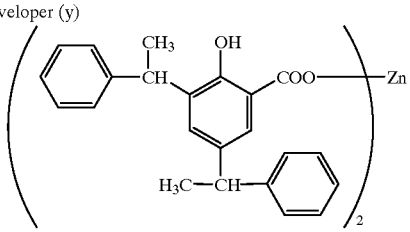

Magenta-Dye-Forming Leuco Dye (z)

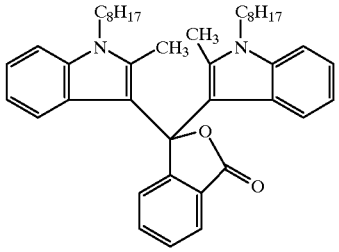

Samples 301 to 304 of multilayer heat-development-type color photosensitive materials shown in Tables 8 through 10 were prepared using thus-obtained silver halide emulsions, coupler dispersions of, and dispersions of coloring agents.

TABLE 8

| | | Samples 301–304 |
|---|---|---|
| Protective layer | Lime-treated gelatin | 1,000 |
| | Matting agent (silica) | 50 |
| | Surfactant (f) | 100 |
| | Surfactant (g) | 300 |
| | Water-soluble polymer (h) | 15 |
| | Hardening agent (1) | 98 |
| Intermediate layer | Lime-treated gelatin | 375 |
| | Surfactant (g) | 15 |
| | Zinc hydroxide | 1,100 |
| | Water-soluble polymer (h) | 15 |
| Yellow dye-forming layer (high sensitive layer) | Lime-treated gelatin | 150 |
| | Emulsion A (converted to the amount of silver coating) | 647 |
| | Yellow coupler (u) | 57 |
| | Developing agent (v) | 41 |
| | Anti foggant (w) | 4 |
| | High-boiling point-organic solvent (d) | 50 |
| | Surfactant (e) | 3 |
| | Water-soluble polymer (h) | 1 |
| Yellow dye-forming layer (intermediate sensitive layer) | Lime-treated gelatin | 220 |
| | Emulsion B (converted to the amount of silver coating) | 475 |
| | Yellow coupler (u) | 84 |
| | Developing agent (v) | 60 |
| | Anti foggant (w) | 6 |
| | High-boiling point-organic solvent (d) | 74 |
| | Surfactant (e) | 4 |
| | Water-soluble polymer (h) | 2 |
| Yellow dye-forming layer (low-sensitive layer) | Lime-treated gelatin | 1,400 |
| | Emulsion C (converted to the amount of silver coating) | 604 |
| | Yellow coupler (u) | 532 |
| | Developing agent (v) | 382 |
| | Anti foggant (w) | 40 |
| | High-boiling point-organic solvent (d) | 469 |
| | Surfactant (e) | 23 |
| | Water-soluble polymer (h) | 10 |

TABLE 9

| | | |
|---|---|---|
| Intermediate layer | Lime-treated gelatin | 750 |
| | Surfactant (e) | 15 |
| | Yellow-dveloping leuco dye (x) | 303 |
| | Developer (y) | 433 |
| | Water-soluble polymer (h) | 15 |
| Magenta dying-forming layer (high-sensitive layer) | Lime-treated gelatin | 220 |
| | Emulsion one of 2-A to 2-D (converted to the amount of silver coating) | 647 |
| | Magenta coupler (a) | 48 |
| | Developing agent (b) | 33 |
| | Anti foggant (c) | 0.02 |
| | High-boiling point-organic solvent (d) | 50 |
| | Surfactant (e) | 3 |
| | Water-soluble polymer (h) | 1 |
| Magenta dye-forming layer (intermediate-sensitive layer) | Lime-treated gelatin | 220 |
| | Emulsion E (converted to the amount of silver coating) | 475 |
| | Magenta coupler (a) | 70 |
| | Developing agent (b) | 49 |
| | Anti foggant (c) | 0.02 |
| | High-boiling point-organic solvent (d) | 74 |
| | Surfactant (e) | 4 |
| | Water-soluble polymer (h) | 2 |
| Magenta dry-forming layer (high-sensitive layer) | Lime-treated gelatin | 1,400 |
| | Emulsion F (converted to the amount of silver coating) | 604 |
| | Magenta coupler (a) | 446 |
| | Developing agent (b) | 311 |

TABLE 9-continued

| | | |
|---|---|---|
| | Anti foggant (c) | 0.14 |
| | High-boiling point-organic solvent (d) | 469 |
| | Surfactant (e) | 23 |
| | Water-soluble polymer (h) | 10 |

TABLE 10

| | | |
|---|---|---|
| Intermediate layer | Lime-treated gelatin | 900 |
| | Surfactant (e) | 15 |
| | Magenta-developing leuco dye (z) | 345 |
| | Developer (y) | 636 |
| | Zinc hydroxide | 1,100 |
| | Water-soluble polymer (h) | 15 |
| Cyan dye-forming layer (high-sensitivity layer) | Lime-treated gelatin | 150 |
| | Emulsion D | 647 |
| | Cyan coupler (aa) | 65 |
| | Developing agent (b) | 33 |
| | Anti foggant (c) | 0.03 |
| | High-boiling point-organic solvent (d) | 50 |
| | Surfactant (e) | 3 |
| | Water-soluble polymer (h) | 1 |
| Cyan dye-forming layer (intermediate sensitity layer) | Lime-treated gelatin | 220 |
| | Emulsion E | 475 |
| | Cyan coupler (aa) | 96 |
| | Developing agent (b) | 49 |
| | Anti foggant (c) | 0.05 |
| | High-boiling point-organic solvent (d) | 74 |
| | Surfactant (e) | 4 |
| | Water-soluble polymer (h) | 2 |
| Cyan dying-forming layer (high sensitivity layer) | Lime-treated gelatin | 1,400 |
| | Emulsion F | 604 |
| | Cyan coupler (aa) | 610 |
| | Developing agent (b) | 311 |
| | Anti foggant (c) | 0.32 |
| | High-boiling point-organic solvent (d) | 469 |
| | Surfactant (e) | 23 |
| | Water-soluble polymer (h) | 10 |
| Antihalation layer | Lime-treated gelatin | 750 |
| | Surfactant (e) | 15 |
| | Leuco dye (ab) | 243 |
| | Developer (y) | 425 |
| | Water-soluble polymer (h) | 15 |
| Clear PET base: 120 $\mu$m | | |

Note:
numerals indicate application amounts (mg/m$^2$).

The photographic characteristics of these photosensitive materials were tested as in Example 1. First, the photosensitive materials were exposed to light at 1000 lux over a period of 1/100 second through an optical wedge.

Water at a temperature of 40° C. was supplied at 15 ml/m$^2$ to the surface of exposed photosensitive materials. Photosensitive materials were brought into face-to-face contact with the processing material used in Example 1. The thus-superposed film was subjected to heat development for 30 seconds at 83° C. through use of the heating drum. The photosensitive materials were peeled from the processing material after the processing, and the transmission density of the magenta-colored wedge-shaped image was measured using a green filter, whereby characteristic curves were obtained. As in Example 1, relative sensitivities were determined by the reciprocal of the amount of exposure corresponding to a density of 0.15 higher than fog density. Sensitivities were represented with reference to the value of sample 301, which was taken as 100.

To examine the granularity of samples, samples were exposed such that the magenta color density became 1.0. Color-developed pieces were prepared by carrying out the same heat development. The RMS granularity of the color-developed pieces was measured at an aperture having a diameter of 48 μm through use of the diffused light source.

The thus-measured RMS values were represented in the form of relative values with reference to the value of the sample 301, which was taken as 100.

With regard to pressure resistance, the samples were exposed to in the same manner as in Examples 1 and 2. Samples were subjected to the same heat development as in the previous examples, as well as to solution development at 38° C. for 195 seconds using a color negative film processor CN-16.

Results are shown in Table 11.

TABLE 11

| Sample No. | Emulsion | Sensitivity | RMS Granularity | Pressure Resistance ΔFog | Pressure Resistance Pressure-desensitize area (%) | Pressure Resistance (Liquid development) ΔFog | Pressure Resistance (Liquid development) Pressure-desensitized area (%) | Remarks |
|---|---|---|---|---|---|---|---|---|
| 301 | 2-A | 100 | 100 | 0.33 | 10 | 0.23 | 30 | Compara. Example |
| 302 | 2-B | 105 | 95 | 0.28 | 10 | 0.21 | 35 | Compara. Example |
| 303 | 2-C | 117 | 105 | 0.15 | 11 | 0.17 | 40 | Invention |
| 304 | 2-D | 123 | 105 | 0.14 | 12 | 0.15 | 45 | Invention |

From the above results, effects of the present invention as acknowledged in Examples 1 and 2 were confirmed.

Example 4

Multi-layered samples were prepared in a manner similar to that described in Example 3, except that the supports were prepared as described below. Tests were similarly performed by use of the resultant samples. Excellent results were obtained, confirming the effects of the present invention.

1) Support

The support used in the present invention was prepared as follows: Polyethylene-2, 6-naphthalate polymer (100 parts by weight) was compounded with Tinuvin P.326 (Ciba-Geigy; a UV absorber, 2 parts by weight) and dried. The compound was melted at 300° C. and extruded through a T-shaped die. The extruded material was subjected to longitudinal stretching (×3.3) at 140° C. and subsequently to transversal stretching (×3.3) at 130° C. The resultant stretched film was thermally set at 250° C. for 6 seconds to thereby obtain a PEN film having a thickness of 90 μm. The PEN film contained suitable amounts of blue dyes, magenta dyes, and yellow dyes (I-1, I-4, I-6, I-24, I-26, I-27, and II-5 described in Kokai Giho (Technical Disclosure Bulletin) No. 94-6023). The film was wound on a stainless steel core having a diameter of 20 cm, and a thermal hysteresis was applied at 110° C. for 48 hours so as to obtain a support which is resistant to curling.

2) Undercoating

The thus-obtained support was subjected on both surfaces to corona discharge treatment, UV discharge treatment, and glow discharge treatment. An undercoat liquid (10 cc/m$^2$) was coated on the support, at the high temperature side during stretching, using a bar coater, in coating amounts of 0.1 g/m$^2$ of gelatin, 0.01 g/m$^2$ of sodium α-sulfo-di-2-ethylhexylsuccinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$, and 0.02 g/m$^2$ of a polyamide-epichlorohydrin polycondensation product. The coated support was dried at 115° C. for 6 minutes. (The temperature of all rollers and conveyors in the drying zone was set to 115° C.)

3) Coating of Backing Layers

On one surface of the thus-obtained undercoated support, backing layers consisting of an antistatic layer, a transparent magnetic recording layer, and a lubricating layer were provided.

3-1) Coating of antistatic layer

An antistatic layer was formed by the application of a mixture in amounts of 0.2 g/m$^2$ of a fine powder dispersion (diameter of secondary agglomerates: about 0.08 μm) of stannic oxide-antimony oxide complex particles having an average diameter of 0.005 μm and a specific resistance of 5 Ω·cm, 0.05 g/m$^2$ of gelatin, 0.02 g/m$^2$ of $(CH_2{=}CHSO_2CH_2CH_2NHCO)_2CH_2$, 0.05 g/m$^2$ of polyoxyethylene-p-nonylphenol (polymerization degree: 10), and resorcin.

3-2) Coating of transparent magnetic recording layer

A magnetic recording layer having a thickness of 1.2 μm was formed by the application, using a bar coater, in amounts of mixture containing 0.06 g/m$^2$ of cobalt-γ-iron oxide coated with 3-polyoxyethylene-propyloxytrimethoxysilane (polymerization degree: 15) in an amount of 15% by weight (specific surface area of the coated particles: 43 m$^2$/g, major axis: 0.14 μm, minor axis: 0.03 μm, saturation magnetization: 89 emu/g, $Fe^{+2}/Fe^{+3}$=6/94, the surfaces are treated with 2% by weight, with resect to the weight of the iron oxide, of aluminum oxide-silicone oxide), 1.2 g/m$^2$ of diacetylcellulose (the iron oxide was dispersed through use of an open kneader and a sand mill), 0.3 g/m$^2$ of $C_2H_5C(CH_2OCONH{-}C_6H_3(CH_3)NCO)_3$ (as a curing agent), and solvents (acetone, methylethylketone, and dibutylphthalate cyclohexanone). The magnetic recording layer also contained 50 mg/m$^2$ of $C_6H_{13}CH(OH)C_{10}H_{20}COOC_{40}H_{81}$ as lubricant, and the following two matting agents: silica particles (1.0 μm) in an amount of 50 mg/m$^2$ and aluminum oxide particles (which serve as grinder particles) coated with 15% by weight of 3-polyoxyethylene-propyloxytrimethoxysilane (polymerization degree: 15) in an amount of 10 mg/m$^2$). Drying was at 115° C. for 6 minutes (the temperature of all rollers and conveyors in the drying zone was set to 115° C.). The increment in color density of $D^B$ in the magnetic recording layer when irradiated with light of X light (blue filter) was approximately 0.1. The saturation magnetization moment of the magnetic recording layer was 4.2 emu/g, coercive force was $7.3\times10^4$ A/m, and the square ratio was 65%.

3-3) Lubricating layer

A lubricating layer was formed by the application of a mixture containing diacetylcellulose (25 mg/m$^2$), $C_6H_{13}CH(OH)C_{10}H_{20}COOC_{40}H_{81}$ (compound a, 6 mg/m$^2$), and a silicone oil (BYK-310, manufactured by Bic chemic, Japan, Co., Ltd.) (1.5 mg/m$^2$). The mixture was applied in the form of a dispersion, which was prepared by melting the mixture in xylene/propyleneglycol monomethyl ether (1/1) at 105° C., pouring the resultant molten mixture into propylene monomethyl ether (10 times in amount) having an ambient temperature to form a dispersion, and further diluting the resultant dispersion in acetone (average particle size: 0.01 μm) . Drying was at 115° C. for 6 minutes (the rollers and conveyors in the drying zone were all set to 115° C.). The resultant lubricant layer had a kinetic friction coefficient of 0.10 (stainless steel balls having a diameter of 5 mm, load: 100 g, and speed: 6 cm/min), a static friction coefficient of 0.08 (clipping method), and a kinetic friction coefficient of 0.15 between the emulsion layer.

As described above, the present invention achieves high sensitivity with improved granularity, and in addition, improved pressure resistance.

What is claimed is:

1. A silver halide color photosensitive material comprising a support provided with at least one photosensitive layer thereon, comprising a light-sensitive silver halide emulsion, a developing agent, a compound which forms a dye through a coupling reaction with an oxidized product of the developing agent, and a binder, the photosensitive material being placed, after exposure, onto a processing material comprising a support provided with a processing layer thereon which contains a base and/or a precursor of a base, with water being supplied between the photosensitive material and the processing material in an amount of 1/10 through 1 times that required to maximally swell the layers of the materials, the resultant assembly being heated to form an image in the photosensitive material, wherein the photosensitive material includes a silver halide emulsion in which tabular silver halide grains having an aspect ratio of 2 to 30 account for 50% to 100% of the total projected area of all silver halide grains and in which 50% to 100% of all silver halide grains in number include 10 or more dislocation lines per grain, wherein the developing agent is a compound represented by one of the following formulae I, II, and III:

Formula I

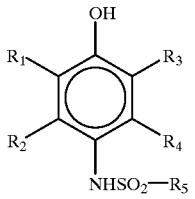

Formula II

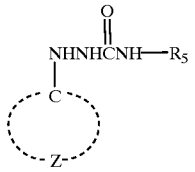

Formula III

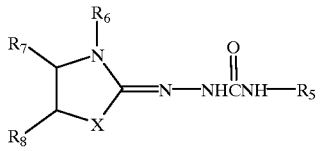

wherein each of $R_1$ to $R_4$ represents a hydrogen atom, a halogen atom, an alkyl group, an aryl group, an alkylcarbonamide group, an arylcarbonamide group, an alkylsulfonamide group, an arylsulfonamide group, an alkoxy group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group, or an acyloxy group; $R_5$ represents an alkyl group, an aryl group, or a heterocyclic group; $R_6$ represents an alkyl group; X represents an oxygen atom, a sulfur atom, a selenium atom, or an alkyl-substituted or aryl-substituted tertiary nitrogen atom; each of $R_7$ and $R_8$ represents a hydrogen atom or a substitutent, and $R_7$ and $R_8$ may be linked to each other to form a ring; and each of the formulae I, II, and III includes at least one ballast group of 8 or more carbon atoms in order to impart oil solubility to molecules.

2. A silver halide color photosensitive material according to claim 1, wherein 80% to 100% of the entirety of the silver halide grains in number includes 10 or more dislocation lines per grain.

3. A silver halide color photosensitive material according to claim 1, wherein the coating amount of the photosensitive silver halide is from 0.01 g to 10 g/m$^2$ of the photosensitive material on a silver basis.

4. A silver halide color photosensitive material according to claim 1, wherein the coating amount of a binder is from 1 g to 20 g/m$^2$ of the photosensitive material.

5. A silver halide color photosensitive material according to claim 1, wherein the coating amount of a compound which forms a dye through a coupling reaction with the oxidized product of the developing agent is from 0.01 g to 10 g/m$^2$ of the photosensitive material.

6. A silver halide color photosensitive material according to claim 1, wherein the coating amount of a developing agent is from 0.1 to 10 moles per mole of silver in the photosensitive material.

7. A silver halide color photosensitive material according to claim 1, wherein the coating amount of a base or its precursor is from 0.1 g to 20 g/m$^2$ of the photosensitive material.

8. A silver halide color photosensitive material according to claim 1, wherein the photosensitive material is thermally developed in a heat development step in the range of about 50° C. to about 250° C.

9. A silver halide color photosensitive material according to claim 1, wherein the base is generated by allowing to react, in the presence of water, a basic metal compound which is slightly soluble in water, with a complex-forming compound capable of forming a complex with a metallic ion of the basic metal compound.

10. A silver halide color photosensitive material according to claim 9, wherein the basic metal compound which is slightly soluble in water is contained in the silver halide color photosensitive material, and the complex-forming compound is contained in the processing material.

11. A method of forming color images comprising the steps of: exposing imagewisely a silver halide color photosensitive material, placing the photosensitive material onto a processing material with water between the photosensitive material and the processing material in an amount of 1/10 through 1 times that required to maximally swell the exposed photosensitive material and the processing material, and heating the resultant assembly to form color images on the silver halide color photosensitive material, wherein said silver halide color photosensitive material comprises a support provided with at least one photosensitive layer thereon, which comprises a photosensitive silver halide emulsion containing tabular silver halide grains having an aspect ratio of 2 to 30, and accounting for 50% to 100% of the total projected area of all silver halide grains, and 50% to 100% of all silver halide grains in number, and having 10 or more dislocation lines per grain, a developing agent, a compound to form a dye through a coupling reaction with an oxidized product of the developing agent, and a binder, and said processing material comprises a support provided with a processing layer thereon which contains a base and/or a precursor of a base and wherein the developing agent is a compound represented by one of the following formulae I, II, and III:

Formula I

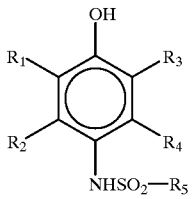

Formula II

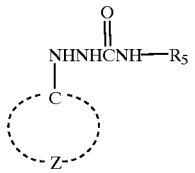

Formula III

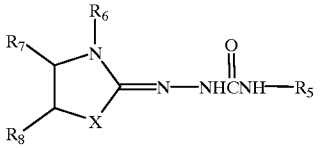

wherein each of $R_1$ to $R_4$ represents a hydrogen atom, a halogen atom, an alkyl group, an aryl group, an alkylcarbonamide group, an arylcarbonamide group, an alkylsulfonamide group, an arylsulfonamide group, an alkoxy group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group, or an acyloxy group; $R_5$ represents an alkyl group, an aryl group, or a heterocyclic group; $R_6$ represents an alkyl group; X represents an oxygen atom, a sulfur atom, a selenium atom, or an alkyl-substituted or aryl-substituted tertiary nitrogen atom; each of $R_7$ and $R_8$ represents a hydrogen atom or a substitutent, and $R_7$ and $R_8$ may be linked to each other to form a ring; and each of the formulae I, II, and III includes at least one ballast group of 8 or more carbon atoms in order to impart oil solubility to molecules.

12. A method of forming color images according to claim 11, wherein 80% to 100% of all the silver halide grains in number has 10 or more dislocation lines per grain.

13. A method for forming color images according to claim 11, wherein the coating amount of the photosensitive silver halide is from 1 mg to 10 g/m$^2$ of the photosensitive material on a silver basis.

14. A method for forming color images according to claim 11, wherein the coating amount of a binder is from 1 g to 20 g/m$^2$ of the photosensitive material.

15. A method for forming color images according to claim 11, wherein the coating amount of a compound which forms a dye through a coupling reaction with the oxidized product of the developing agent is from 0.01 g to 10 g/m$^2$ of the photosensitive material.

16. A method for forming color images according to claim 11, wherein the coating amount of a developing agent is from 0.1 to 10 mole per mole of silver in the photosensitive material.

17. A method for forming color images according to claim 11, wherein the coating amount of a base or its precursor is from 0.1 g to 20 g/m$^2$ of the photosensitive material.

18. A method for forming color images according to claim 11, wherein the photosensitive material is thermally developed in a heat development step in the range of about 50° C. to about 250° C.

19. A method of forming color images according to claim 11, wherein after supplying water to the silver halide color photosensitive material or the silver halide color processing material in an amount of 1/10 through 1 times that required to maximally swell the photosensitive material and the processing material, the photosensitive material and the processing material are placed together, and heated to a temperature of 60° C. to 100° C., with the temperature maintained for a period of 5 to 60 seconds.

20. A method of forming color images according to claim 11, wherein the base is generated by allowing to react, in the presence of water, a basic metal compound which is slightly soluble in water, with a complex-forming compound capable of forming a complex with a metallic ion of the basic metal compound.

21. A method of forming color images according to claim 11, wherein the basic metal compound which is slightly soluble in water is contained in the silver halide color photosensitive material, and the complex-forming compound is contained in the processing material.

* * * * *